US009022126B2

(12) United States Patent
Melancon et al.

(10) Patent No.: US 9,022,126 B2
(45) Date of Patent: May 5, 2015

(54) WELLSITE EQUIPMENT REPLACEMENT SYSTEM AND METHOD FOR USING SAME

(75) Inventors: Jeffrey Thomas Melancon, Willis, TX (US); Denzal Wayne Van Winkle, Santa Maria, CA (US); James Allen Douty, The Woodlands, TX (US)

(73) Assignee: National Oilwell Varco, L.P., Houston, TX (US)

( * ) Notice: Subject to any disclaimer, the term of this patent is extended or adjusted under 35 U.S.C. 154(b) by 581 days.

(21) Appl. No.: 13/375,646

(22) PCT Filed: Jun. 15, 2010

(86) PCT No.: PCT/US2010/038584

§ 371 (c)(1),
(2), (4) Date: Feb. 8, 2012

(87) PCT Pub. No.: WO2011/002602

PCT Pub. Date: Jan. 6, 2011

(65) Prior Publication Data

US 2012/0125622 A1 May 24, 2012

Related U.S. Application Data

(60) Provisional application No. 61/222,251, filed on Jul. 1, 2009.

(51) Int. Cl.

| | |
|---|---|
| ***E21B 7/12*** | (2006.01) |
| ***E21B 33/08*** | (2006.01) |
| ***E21B 33/076*** | (2006.01) |

(52) U.S. Cl.

CPC ..... *E21B 33/08* (2013.01); *E21B 33/076* (2013.01)

(58) Field of Classification Search

CPC ..... E21B 17/02

USPC ..... 166/338, 341, 344, 360; 277/323

See application file for complete search history.

(56) References Cited

U.S. PATENT DOCUMENTS

| | | | |
|---|---|---|---|
| 1,997,152 | A | 4/1935 | Penick et al. |
| 3,463,226 | A | 8/1969 | Johnson et al. |

(Continued)

FOREIGN PATENT DOCUMENTS

| | | |
|---|---|---|
| EP | 1061231 | 12/2000 |

OTHER PUBLICATIONS

International Preliminary Report on Patentability for International Application No. PCT/US2010/038584 dated Jan. 4, 2012.

(Continued)

*Primary Examiner* — Matthew Buck
*Assistant Examiner* — Aaron Lembo
(74) *Attorney, Agent, or Firm* — JL Salazar Law Firm

(57) ABSTRACT

A system and method for replacing equipment at a wellsite is provided. The wellsite has a subsea stripper installed proximate a subsea borehole. The system has a conveyance for delivering a BHA into the subsea borehole. The system has a subsea stripper having a central bore for passing the conveyance and the BHA therethrough, and at least one actuator connected to the subsea stripper for actuating a packer whereby the wellbore is sealed. The system has at least one replaceable seal assembly for installation within the stripper. The replaceable seal assembly has at least one packer extendable within the subsea stripper to form a seal thereabout and at least one locator sleeve for positioning the seal assembly in an install position within the subsea stripper. The replaceable seal assembly has a frangible member for connecting the seal assembly to the conveyance prior to deployment in the subsea stripper.

24 Claims, 25 Drawing Sheets

(56) References Cited

U.S. PATENT DOCUMENTS

| | | | | |
|---|---|---|---|---|
| 3,561,723 | A * | 2/1971 | Cugini | 251/1.2 |
| 3,583,480 | A | 6/1971 | Regan | |
| 3,662,823 | A | 5/1972 | Murman et al. | |
| 3,717,000 | A | 2/1973 | Rothwell | |
| 3,741,295 | A | 6/1973 | Murman et al. | |
| 3,741,296 | A | 6/1973 | Murman et al. | |
| 4,003,430 | A | 1/1977 | Carnahan | |
| 4,133,342 | A | 1/1979 | Carnahan | |
| 4,220,206 | A | 9/1980 | Van Winkle | |
| 4,262,748 | A * | 4/1981 | Kirkland | 166/348 |
| 4,392,633 | A | 7/1983 | Van Winkle | |
| 4,416,441 | A | 11/1983 | Van Winkle | |
| 4,646,825 | A | 3/1987 | Van Winkle | |
| 4,648,782 | A | 3/1987 | Kraft | |
| 4,690,033 | A | 9/1987 | Van Winkle | |
| 4,690,411 | A | 9/1987 | Van Winkle | |
| 4,813,495 | A * | 3/1989 | Leach | 175/6 |
| 4,899,823 | A | 2/1990 | Cobb et al. | |
| 4,923,005 | A | 5/1990 | Laky et al. | |
| 4,943,031 | A | 7/1990 | Van Winkle | |
| 4,986,360 | A | 1/1991 | Laky et al. | |
| 5,505,426 | A | 4/1996 | Whitby et al. | |
| 5,515,925 | A | 5/1996 | Boychuk | |
| 5,566,753 | A | 10/1996 | Van Winkle et al. | |
| 5,735,502 | A | 4/1998 | Levett et al. | |
| 5,897,094 | A | 4/1999 | Brugman et al. | |
| 5,961,094 | A | 10/1999 | Van Winkle | |
| 5,975,484 | A | 11/1999 | Brugman et al. | |
| 6,006,647 | A | 12/1999 | Van Winkle | |
| 6,012,528 | A | 1/2000 | Van Winkle | |
| 6,113,061 | A | 9/2000 | Van Winkle | |
| 6,164,619 | A | 12/2000 | Van Winkle et al. | |
| 6,230,824 | B1 * | 5/2001 | Peterman et al. | 175/214 |
| 6,244,560 | B1 | 6/2001 | Johnson | |
| 6,321,846 | B1 * | 11/2001 | Rytlewski | 166/363 |
| 6,364,021 | B1 | 4/2002 | Coats | |
| 6,439,302 | B1 | 8/2002 | Wiedemann | |
| 6,457,526 | B1 | 10/2002 | Dailey | |
| 6,484,808 | B2 | 11/2002 | Jones et al. | |
| 6,742,597 | B2 | 6/2004 | Van Winkle et al. | |
| 6,857,634 | B2 | 2/2005 | Araujo | |
| 7,096,960 | B2 | 8/2006 | Hemphill et al. | |
| 7,114,571 | B2 * | 10/2006 | Gatherar et al. | 166/367 |
| 7,165,619 | B2 | 1/2007 | Fox et al. | |
| 7,181,808 | B1 | 2/2007 | Van Winkle | |
| 7,207,384 | B2 * | 4/2007 | Dallas et al. | 166/250.08 |
| 7,431,092 | B2 * | 10/2008 | Haheim et al. | 166/343 |
| 7,523,644 | B2 | 4/2009 | Van Winkle | |
| 8,387,701 | B2 * | 3/2013 | Sbordone | 166/338 |
| 8,875,798 | B2 | 11/2014 | Van Winkle | |
| 2002/0074131 | A1 | 6/2002 | Jones et al. | |
| 2003/0079881 | A1 | 5/2003 | Moss | |
| 2004/0124380 | A1 | 7/2004 | Van Winkle | |
| 2005/0061499 | A1 | 3/2005 | Hopper | |
| 2005/0077043 | A1 * | 4/2005 | Dallas | 166/250.01 |
| 2005/0279494 | A1 * | 12/2005 | Sachdeva et al. | 166/135 |
| 2006/0076526 | A1 | 4/2006 | McWhorter et al. | |
| 2007/0051164 | A1 | 3/2007 | Van Winkle | |
| 2008/0121429 | A1 | 5/2008 | Bamford | |
| 2008/0185152 | A1 | 8/2008 | Sbordone et al. | |
| 2008/0185153 | A1 | 8/2008 | Smedstad et al. | |
| 2008/0277122 | A1 * | 11/2008 | Tinnen | 166/339 |
| 2009/0050329 | A1 | 2/2009 | Johnson et al. | |
| 2009/0152817 | A1 | 6/2009 | Du | |
| 2011/0315404 | A1 * | 12/2011 | Bailey et al. | 166/387 |
| 2012/0125622 | A1 | 5/2012 | Melancon et al. | |
| 2013/0192847 | A1 * | 8/2013 | Bailey et al. | 166/373 |

OTHER PUBLICATIONS

PCT Search Report for International Application No. PCT/US2010/038584 dated Feb. 7, 2011.

Texas Oil Tools, 4.06" 10/15K DSW4/DSW6 2 Door Stripper Packer, Series D Tech Unit D601000258-001/01, Mar. 2008.

Dictionary definition of "about", accessed on Nov. 20, 2013 via thefreedictionary.com.

Dictionary definition of "about", accessed on Jul. 18, 2013 via thefreedictionary.com.

Extended European Search Report for Patent Application No. 10160935.2 dated Aug. 27, 2013, 8 pages.

Schlumberger Oilfield Glossary entry for "stripping", accessed Feb. 8, 2013 via www.glossary.oilfield.slb.com.

* cited by examiner

WELLSITE EQUIPMENT REPLACEMENT SYSTEM AND METHOD FOR USING SAME

CROSS REFERENCE TO RELATED APPLICATION

This application claims the benefit of U.S. Provisional Application No. 61/222,251 filed Jul. 1, 2009, the entire content of which is hereby incorporated by reference.

BACKGROUND OF THE INVENTION

The present invention relates to techniques for replacing equipment at a wellsite. More specifically, the invention relates to techniques for replacing equipment, such as blow-out preventers (BOPs), strippers, and/or components thereof used, for example, in subsea applications.

Oilfield operations are typically performed to locate and gather valuable downhole fluids. Oil rigs are positioned at wellsites, and downhole tools, such as drilling tools, are deployed into the ground to reach subsurface reservoirs. Many oilfield operations occur in the sea, or ocean. Subsea oilfield operations typically require the wellhead and other wellsite equipment to be located on the seabed, while an oil platform or vessel may be located at the water's surface. The wellsite equipment located at the seabed may comprise equipment, such as blow out preventers (BOPs), strippers, control devices, supporting tubing injectors, tubing reels, wireline units, or other subsea equipment.

In sub-sea oil and gas operations, there is often a need for a pressure barrier for moving conveyances, such as a slickline or coiled tubing. The stripper may act as a seal, or pressure barrier, that the conveyance is run through. As the coiled tubing is fed through the stripper, the stripper may seal the outer surface of the coiled tubing, thereby preventing sea water from entering the well, and/or wellbore fluids from leaving the wellbore inadvertently. The BOP may act as a safety device designed to 'seal in' large pressure surges in the wellbore. The BOP may have rams that automatically shut thereby closing and sealing in the wellbore.

The subsea equipment may become damaged over the life of the drilling operations. In some cases, the subsea equipment may be repaired and/or replaced by subsea divers, and/or brought to the surface by the diver. Techniques for performing repairs and/or replacement of certain wellsite equipment are disclosed, for example, in U.S. Pat. Nos. 3,741,296; 6,484,808; 5,961,094; 6,012,528; and 6,113,061 and U.S. Publication Nos. 2008/0185153; 2008/0185152; and 2009/0152817, the entire contents of which are incorporated by reference.

Despite the development of techniques for replacing BOP and/or stripper components, there remains a need to provide advanced techniques for performing replacement operations.

SUMMARY

In at least one aspect, the present invention relates to a replaceable seal assembly. The replaceable seal assembly is for sealing equipment at a wellsite. The wellsite has a subsea stripper installed proximate a subsea borehole and a conveyance for delivering a BHA into the subsea borehole. The replaceable seal assembly has at least one packer extendable within the subsea stripper to form a seal thereabout. The replaceable seal assembly has at least one locator sleeve for positioning the seal assembly in an install position within the subsea stripper. The replaceable seal assembly has a frangible member for connecting the seal assembly to the conveyance prior to deployment in the subsea stripper.

The packer(s) of the replaceable seal assembly may have two packers with the at least one locator sleeve located therebetween, and an actuation sleeve(s) for actuating the at least one packer. The actuation sleeve(s) of the replaceable seal assembly may have a tapered end for engaging an actuator of the subsea stripper. The tapered end axially aligns the seal assembly within the subsea stripper. The locator sleeve(s) of the replaceable seal assembly may have a guide for aligning the seal assembly in the install position when the guide is engaged by a locator sleeve actuator of the subsea stripper. The guide may have a reduced necked-down dual chamfer. The replaceable seal assembly may have a sleeve connection member for linearly coupling the at least one packer to the at least one locator sleeve, and a neck portion of the locator sleeve and having a shoulder extending therefrom, and a connector segment having a groove and at least one upset proximate to the groove, wherein the groove is for receiving the shoulder. The connector segment may have a plurality of connector segment joints for radially expanding and contracting the connector segment. The frangible member of the replaceable seal assembly may be a shear pin and/or a neck-down shear area.

In at least one aspect, the present invention relates to a system for replacing equipment at a wellsite. The wellsite has subsea equipment installed proximate a subsea borehole and a conveyance for delivering a BHA into the subsea borehole. The system has a subsea stripper having a central bore for passing the conveyance and the BHA therethrough. The system has at least one replaceable seal assembly for installation within the stripper. The replaceable seal assembly has at least one packer extendable within the subsea stripper to form a seal thereabout. The replaceable seal assembly has at least one locator sleeve for positioning the seal assembly in an install position within the subsea stripper. The replaceable seal assembly has a frangible member for connecting the seal assembly to the conveyance prior to deployment in the subsea stripper. The system has at least one actuator for actuating the packer whereby the wellbore is sealed.

The actuator(s) of the system has a packer actuator and a locator actuator. The locator actuator of the system is for engaging a locator sleeve of the seal assembly and thereby moving the seal assembly to an install position. The locator actuator of the system has an engager for mating with a guide on the locator sleeve. The packer actuator of the system has a motivator for motivating the packer within the subsea stripper and the motivator moves in a longitudinal direction relative to the seal assembly during actuation of the packer and moves in a radial direction in order to allow the seal assembly to be installed and removed from the stripper. The motivator of the system has a slip surface for engaging a bowl of the packer actuator and the slip surface and the bowl are for facilitating the movement of the motivator in the radial direction. The motivator of the system may engage an actuator sleeve of the seal assembly.

In at least one aspect, the present invention relates to a method for replacing equipment at a wellsite. The wellsite has a subsea stripper located proximate a subsea wellbore. The method comprises connecting a seal assembly to a conveyance for delivering a BHA. The seal assembly has at least one packer extendable within the subsea stripper to form a seal thereabout. The seal assembly has at least one locator sleeve for positioning the seal assembly in an install position within the subsea stripper. The seal assembly has a frangible member for connecting the seal assembly to the conveyance prior to deployment in the subsea stripper. The method comprises deploying the conveyance into the subsea stripper and passing the seal assembly past at least one actuator within the subsea stripper. The method comprises locating the seal assembly in the install position with a locator actuator. The method comprises actuating at least one of the packers of the seal assembly into sealing engagement with the conveyance.

The locating of the seal assembly comprises actuating a motivator of at least one packer actuator into a position for engaging the seal assembly. Further, the locating of the seal assembly comprises engaging the motivator with seal assembly. The method comprises breaking the frangible member and thereby disengaging the conveyance from the seal assembly and opening a stop located below the subsea stripper after the seal assembly is in sealing engagement with the conveyance. The method comprises running the conveyance and the BHA past the stop and performing downhole operations. The method comprises removing the seal assembly, the conveyance and the BHA from the subsea stripper and installing a new conveyance with a new seal assembly, wherein the conveyance has an outer diameter and the new conveyance has second outer diameter.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale and certain features and certain views of the Figures may be shown exaggerated in scale or in schematic in the interest of clarity and conciseness.

DETAILED DESCRIPTION OF THE INVENTION

The description that follows includes exemplary apparatus, methods, techniques, and instruction sequences that embody techniques of the present inventive subject matter. However, it is understood that the described embodiments may be practiced without these specific details.

It may be desirable to provide techniques that are capable of performing at even high depths. It may be further desirable that such techniques be performed remotely and/or automatically. Preferably, such techniques involve one or more of the following, among others: efficient replacement, reduced downtime, simpler structure, reduced manning, etc. The present invention is directed to fulfilling this need in the art.

This application relates to a pressure barrier, such as that provided by a packer, or seal assembly disclosed herein, that contains two sealing elements, or packers, into the same body or housing so that tools can be delivered and retrieved therethrough without the limitation of having to disconnect the guide, for example. This may result in a sealing mechanism, or seal assembly, that may either be retrievable or have the functionality to seal on small diameters (e.g., slickline) while being capable of opening to a diameter large enough for tools to pass through. A tool catcher may also be included.

Such a dynamic seal, or seal assembly, may include a body with a single packer element, although two complete units may be used to comply with certain operational requirements. However, a dual-packer system within a single body or housing is shown and described below.

The structure disclosed herein may be applied to a unit, or stripper, to accommodate both coiled tubing and slickline; or may be adapted to one or the other of these applications, such as, for example, slickline-specific. The system also preferably provides a dual acting piston, packer actuators, and system that allows full control over de-energizing the packing element, or packers, when returning to surface.

The dual-packer structure shown and described below may provide a number of advantages over using two complete single-packer arrangements. For example, the dual-packer assembly reduces the overall weight of the system. This design provides the same functionality as its dual-packer predecessor and weighs an estimated 42% less than its predecessor. The dual-packer structure is also modular in design.

The unit is comprised of modular subassemblies, or seal assembly. Downtime may be reduced due to the ability to replace upper or lower subassemblies. The dual-packer structure also preferably has fewer components. The design may rely on two actuators, or packer actuators, versus six. This arrangement also may have fewer hydraulic circuits. Two tandem single-packer assemblies may use five hydraulic circuits; whereas, the dual-packer system may require only three.

Figure 1:
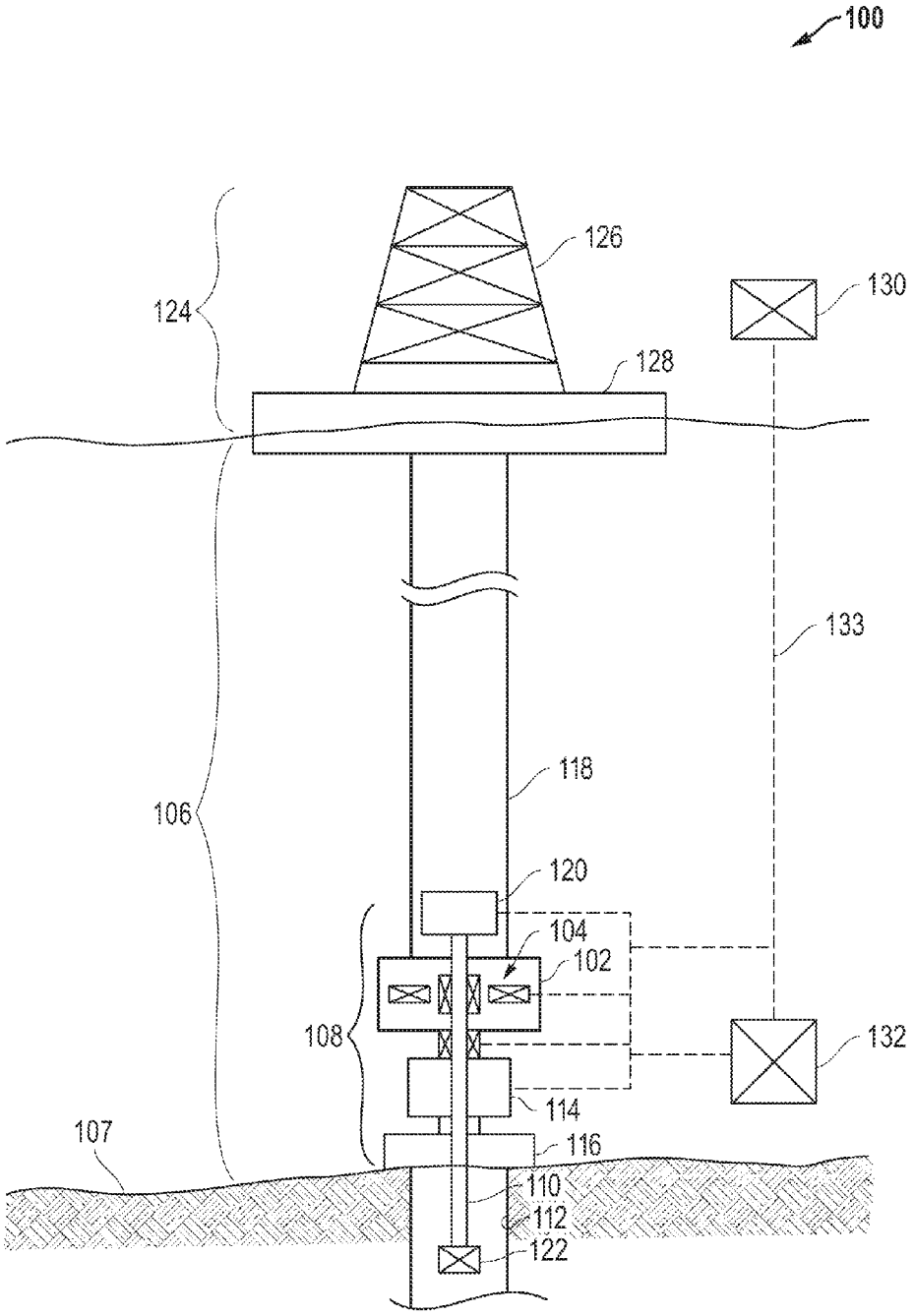
FIG. 1 shows a schematic view of an offshore wellsite having a subsea assembly for replacing equipment, the subsea assembly comprising a subsea stripper and an equipment replacement system.

FIG. 1 depicts an offshore wellsite 100 having a stripper 102 with an equipment replacement system 104. The equipment replacement system 104 is preferably configured for replacing subsea equipment without the need for removing the equipment, such as the stripper 102, using, for example, a remotely operated vehicle (ROV) and/or a diver to replace the equipment. As shown, the equipment replacement system 104 is located within the stripper 102 of a subsea system 106 positioned on a seabed 107. A portion of the equipment replacement system 104 may be configured to run into the subsea equipment 108 on a conveyance 110. The equipment replacement system 104 may then be actuated in order to seal the conveyance 110 within the stripper 102 while allowing the conveyance 110 to move into and/or out of a wellbore 112.

The subsea system 106 may comprise the stripper 102, a blow out preventer (BOP) 114, a wellhead 116, a conduit 118, and a conveyance delivery system 120. The conveyance delivery system 120 may be configured to convey one or more downhole tools 122 into the wellbore 112 on the conveyance 110. Although the equipment replacement system 104 is described as being used in subsea operations, it will be appreciated that the wellsite may be land or water based and the equipment replacement system 104 may be used in any drilling environment. A surface system 124 may be used to facilitate the oilfield operations at the offshore wellsite 100. The surface system 124 may comprise a rig 126, a platform 128 (or vessel) and a controller 130. Further, there may be one or more subsea controllers 132. As shown the controller 130 is at a surface location and the subsea controller 132 is in a subsea location, it will be appreciated that the one or more controllers 130/132 may be located at various locations to control the surface and/or subsea systems.

The conveyance delivery system 120, as shown, is located proximate the subsea equipment 108, for example the stripper 102 and the BOP 114. The conveyance 110 in an example may be a coiled tubing. The conveyance delivery system 120 may be, for example, a coiled tubing injector. The coiled tubing injector may inject and/or motivate the coiled tubing and/or downhole tool 122 into the wellbore 112 through the subsea equipment 108. As shown, the conveyance delivery system 120 is located within the conduit 118, although it should be appreciated that it may be located at any suitable location, such as at the sea surface, proximate the subsea equipment 108, without the conduit 118, and the like. Although the conveyance delivery system 120 is described as being a coiled tubing injector, it should be appreciated that the conveyance delivery system 120 may be any suitable device for conveying the conveyance 110 through the subsea equipment 108 and into the wellbore 112. Further, the conveyance 110 may be any suitable conveyance 110 such as a wireline, a slickline, a production tubing, and the like. The downhole tools 122 may be any suitable downhole tools for drilling, completing, evaluating and/or producing the wellbore 112, such as drill bits, packers, testing equipment, perforating guns, and the like.

The stripper 102 is preferably configured to allow the conveyance 110 to pass through the stripper 102 and into other subsea equipment, such as the BOP 114, without allowing seawater into the wellbore 112 and/or allowing wellbore fluids out of the wellbore 112. Portions of the equipment replacement system 104 may be located in and/or proximate to the stripper 102. Portions of the equipment replacement system 104 may further be locatable within the stripper 102 and may be run into the stripper 102 on the conveyance 110.

Figure 2:
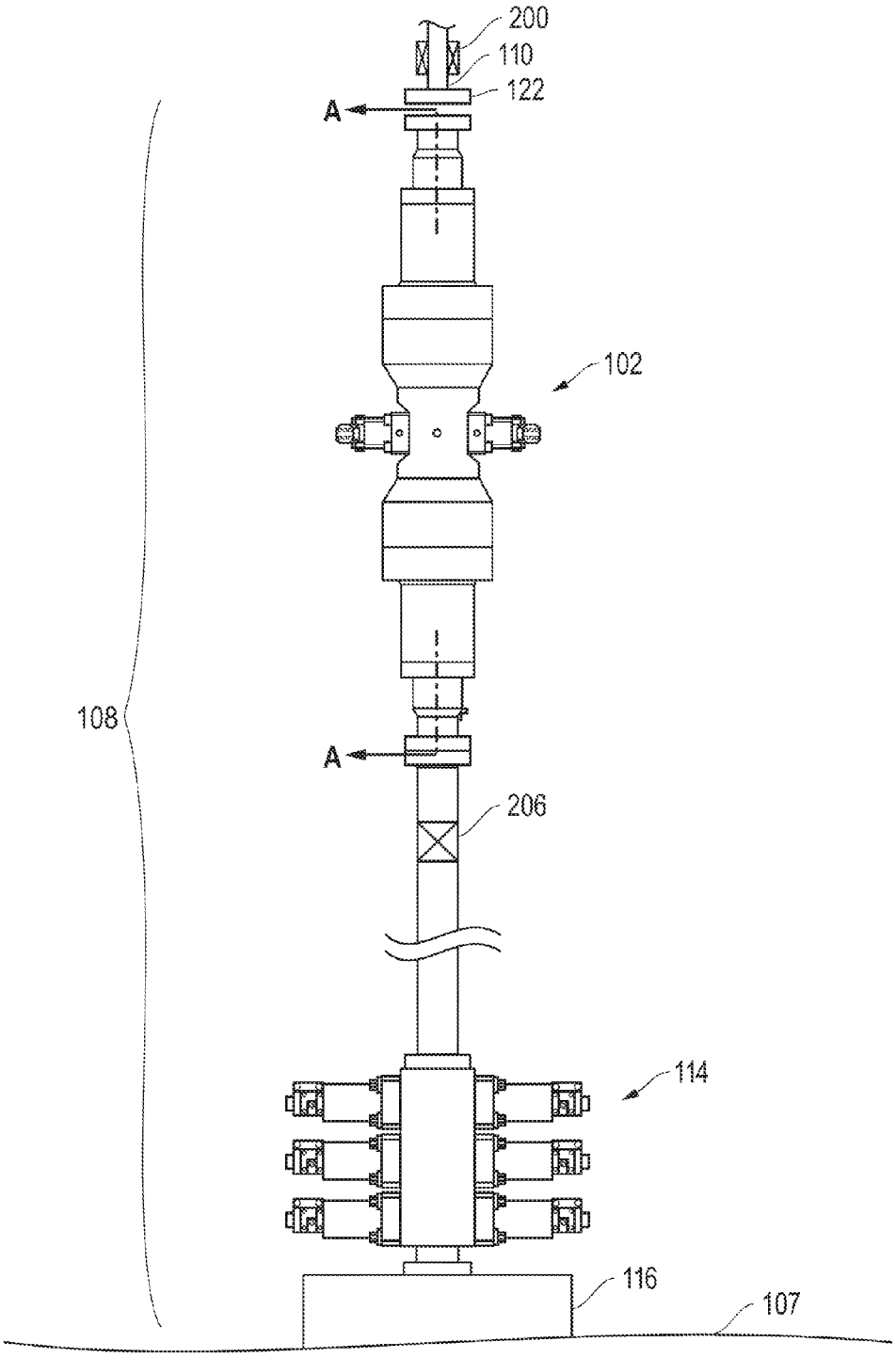
FIG. 2 shows a schematic view of a portion of the subsea assembly of FIG. 1.

FIG. 2 shows a schematic view of the subsea equipment 108 as shown in FIG. 1. The equipment replacement system 104, as shown, comprises the stripper 102 and a seal assembly 200. The seal assembly 200 may be run in on the conveyance 110 with a downhole tool 122 thereon disposable through the stripper 102. The stripper 102, the BOP 114 and/or a stop 206 may be installed on the wellhead 116 of seabed 107. The stripper 102 may initially not have the seal assembly 200 within the stripper 102. The conveyance 110 coupled to the seal assembly 200 may be located proximate the stripper 102. Prior to installation of the seal assembly 200 into the stripper 102, the stripper 102 may be in the unactuated, or open position, as will be discussed in more detail below.

FIG. 3A-3D each show a longitudinal, cross-section view of the stripper 102, of FIG. 2 taken along line A-A, and a schematic, cross-sectional view of the equipment replacement system 104 of FIGS. 1 and 2 having the seal assembly 200 and one or more actuators 202 located within the subsea equipment 108. The FIGS. 3A-3D depict a sequence for using the equipment replacement system 104. The seal assembly 200 may be connected to the conveyance 110 prior to locating the seal assembly 200 into the subsea equipment 108. The conveyance 110 may deliver the seal assembly 200 into the subsea equipment 108 where the one or more actuators 202 may locate the seal assembly 200 in the proper (or install) position, and/or actuate one or more packer assemblies 204 in the seal assembly 200, as will be describe in more detail below.

Figure 3A:
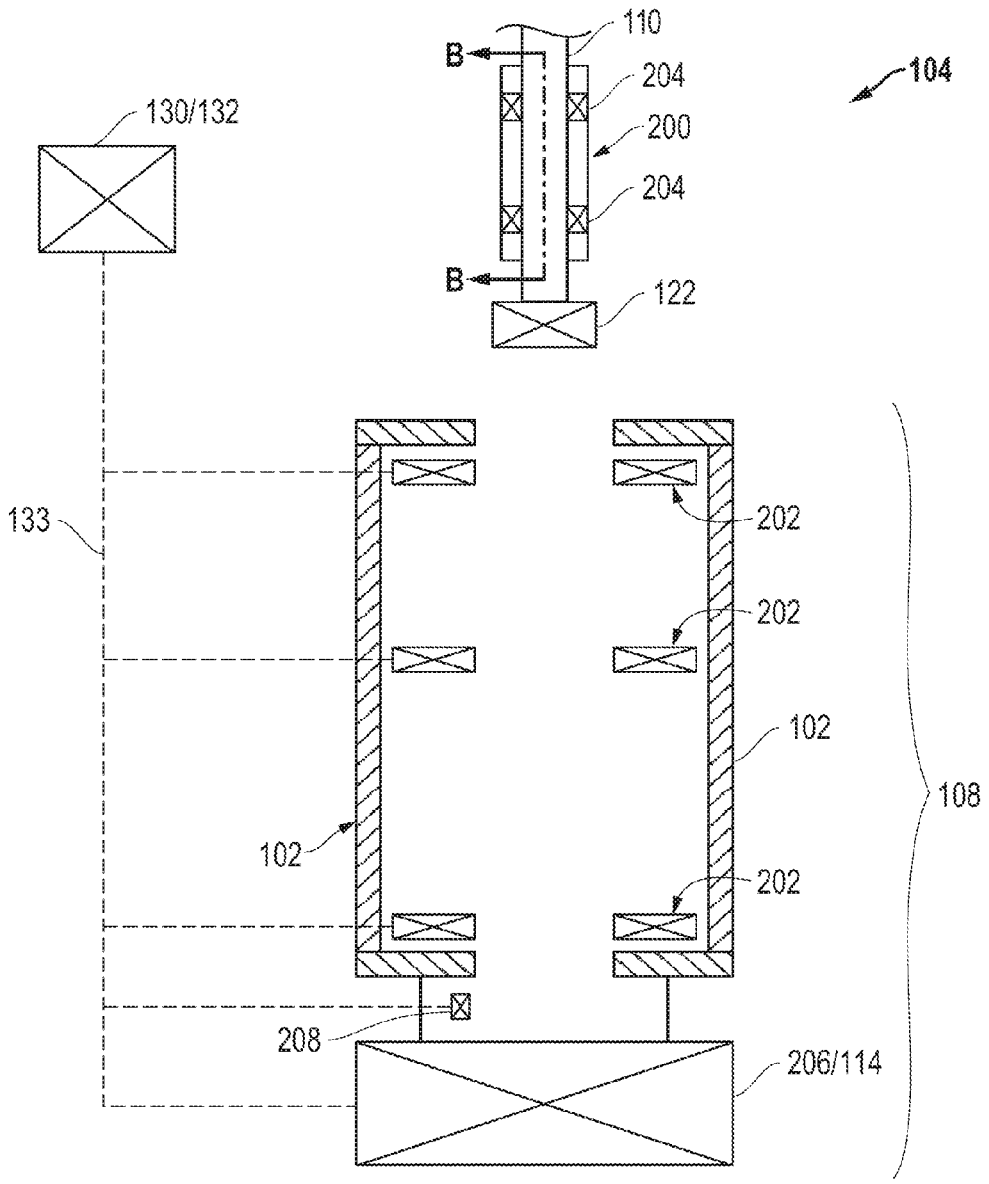
FIGS. 3A-3D show a schematic, cross-sectional view of a stripper of FIG. 2 depicting the operation of the equipment replacement system of FIG. 1 therewith, the equipment replacement system having a seal assembly therein.

As shown in FIGS. 3A-3D, the seal assembly 200 is run into the stripper 102 wherein the one or more actuators 202 actuate the seal assembly 200 into a sealing engagement with the conveyance 110. Initially all of the one or more actuators 202 are in an open position as shown in FIG. 3A. In the open position, the downhole tools 122, the conveyance 110 and/or the seal assembly 200 may pass through the actuators 202 without obstruction. FIG. 3A shows the seal assembly 200 secured to the conveyance 110 prior to being run into the subsea equipment 108. As shown, the seal assembly 200 will be run into and secured in the stripper 102. The seal assembly 200 may be removed from the conveyance 110 once secured in the stripper 102, for example, by a frangible connection as will be described in more detail below. Although the FIGS. 3A-3D show the seal assembly 200 being secured about the stripper 102. The seal assembly 200 may be secured about any of the suitable subsea equipment 108, such as the BOP 114 (as shown in FIG. 1).

Figure 3B:
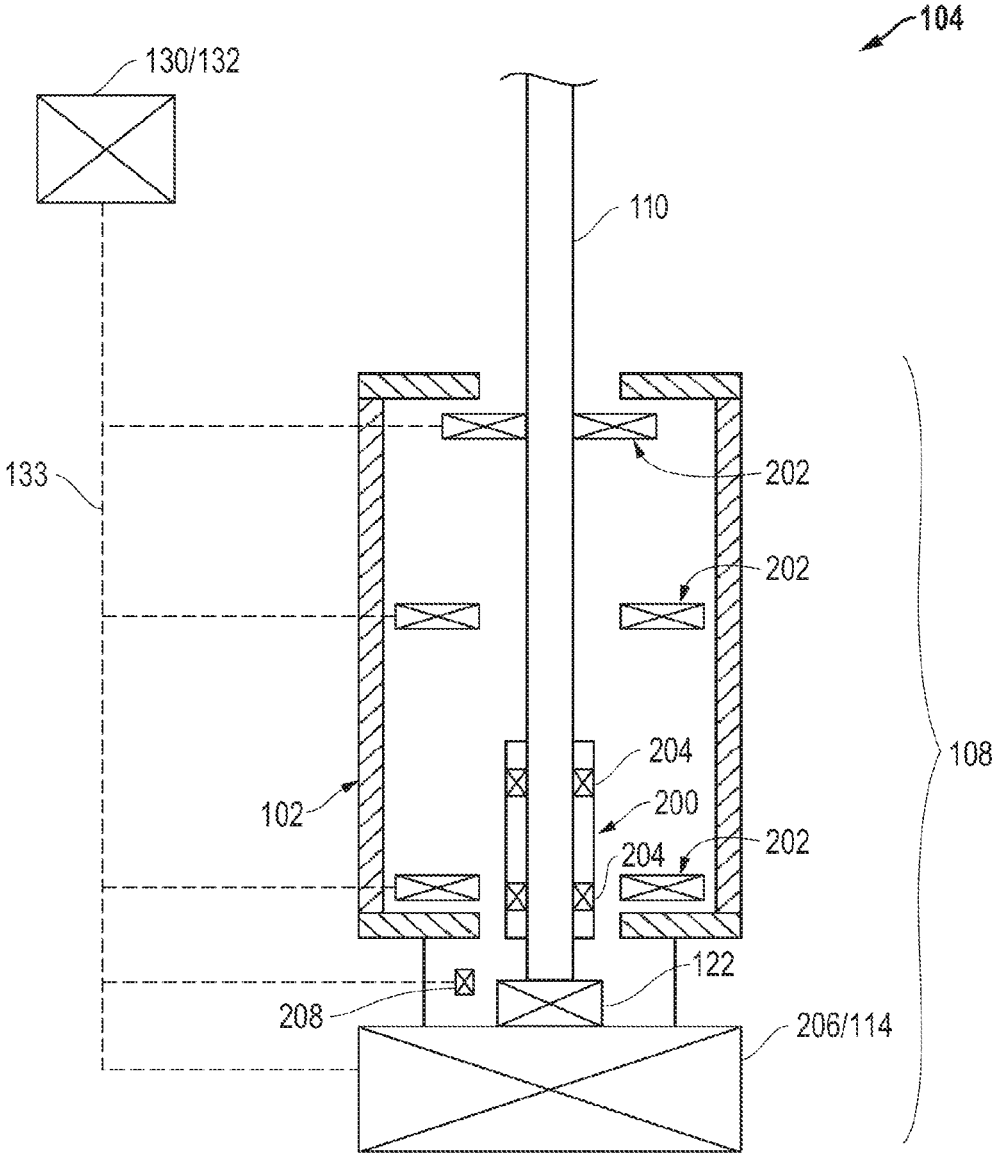

The seal assembly 200 coupled to the conveyance 110 may then be run into the subsea equipment 108 until the downhole tool 122, the end of the conveyance 110 and/or a portion of the seal assembly 200 engages a stop 206 as shown in FIG. 3B. As shown, the downhole tool 122 engages the stop 206. The stop 206 may be any suitable device for stopping the conveyance 110 and/or notifying the controller(s) 130/132, or operator that the seal assembly 200 is within the stripper 102. The stop 206 may be a valve, a ram of the BOP 114 and/or a sensor 208 located in the subsea equipment 108. As shown, in FIG. 3B, the stop is located at a position below the stripper 102. This position may allow the entire seal assembly 200 to enter stripper 102 prior to stopping the conveyance 110. With the stop 206 engaged, one of the one or more the actuators 202 may be actuated in order to engage the seal assembly 200.

Once the downhole tool(s) 122 (or tool string) with the seal assembly 200 (or consumable arrangement) has been logistically located about the stripper 102, the upper actuator 202 (or the upper piston) may be closed. The uppermost of the actuators 202 (or an upper locking sleeve) may be actuated in order to move a portion of the actuator 202 to a location proximate the conveyance 110. With the uppermost actuator 202 actuated, the conveyance 110 may be pulled up to locate the seal assembly 200 proximate the stripper 102, as shown in FIG. 3C.

Figure 3C:
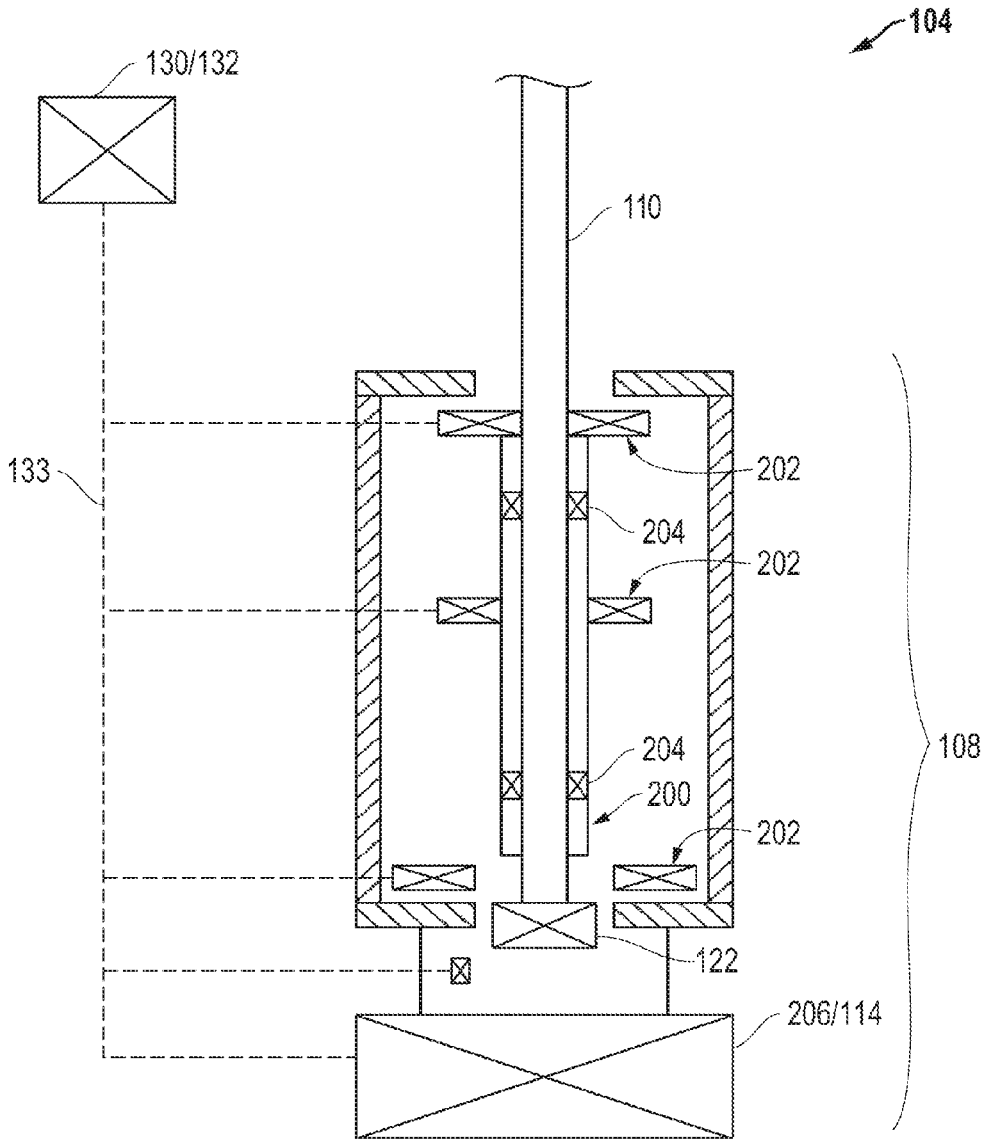

The uppermost actuator 202 may engage the seal assembly 200 as the conveyance 110 is pulled up in order to locate the seal assembly 200 proximate an actuation position as shown in FIG. 3C. Another of the actuators 202 may then be actuated in order to locate the seal assembly 200 in the install position. As shown, the middle actuator 202 may engage the seal assembly 200 in order to locate the seal assembly 200 in the install position. The seal assembly 200 and/or the actuator(s) 202 may have a locator, or a locator sleeve, configured to locate the seal assembly 200 in the install position as will be discussed in more detail below.

Figure 3D:
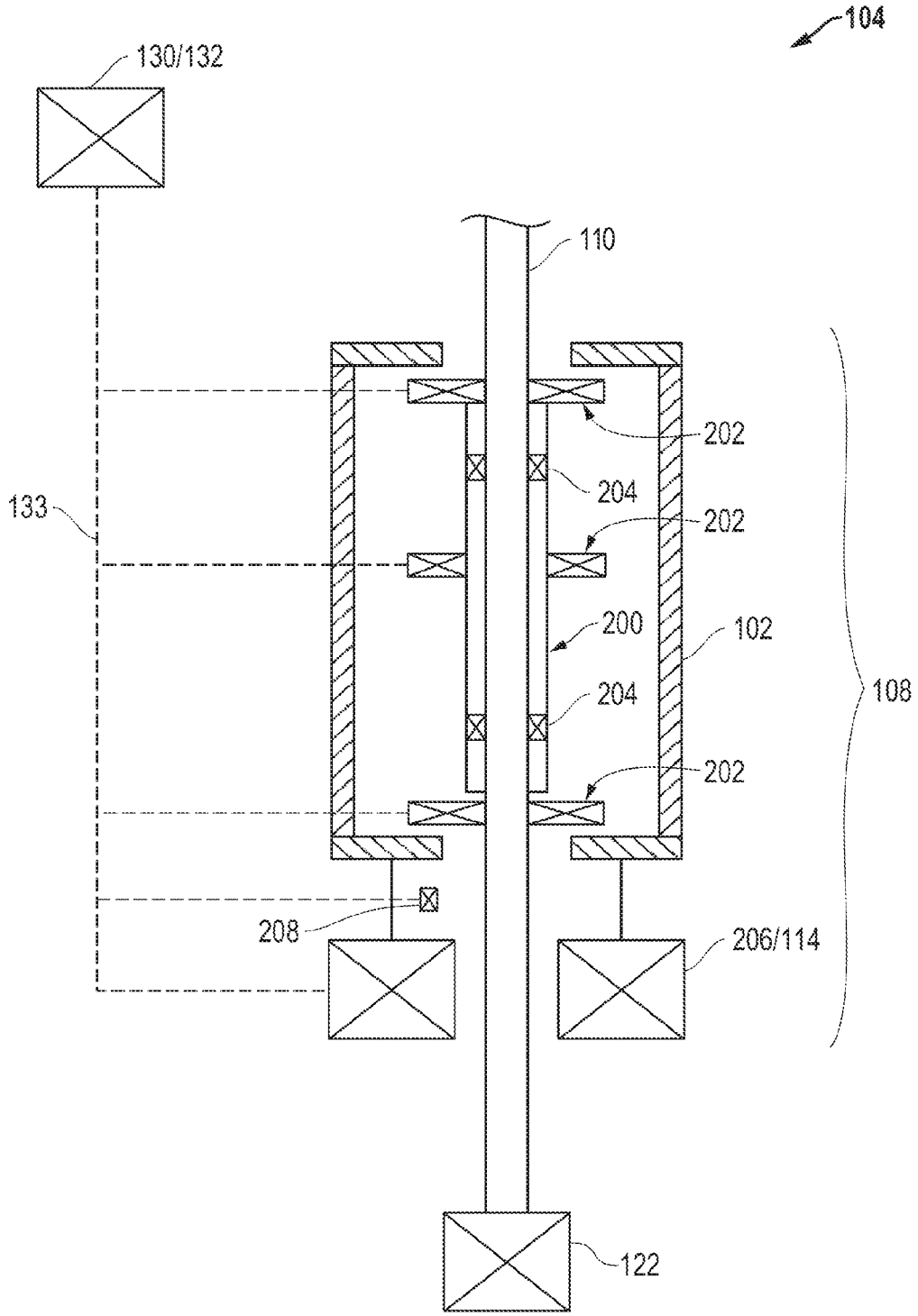

With the seal assembly 200 in the install position, the actuators 202 may all be actuated in order to secure the seal assembly in the stripper 102 and/or engage the one or more packer assemblies 204 into a sealing engagement with the conveyance 110, as shown in FIG. 3D.

The upper actuator and lower actuator 202 may be configured to actuate the one or more packer assemblies 204 into sealing engagement with the conveyance 110 while the middle actuator 202 may be configured to locate the seal assembly 200 in the install position. With the seal assembly 200 in sealing engagement with the conveyance 110, the conveyance 110 may be detached from the seal assembly 200, for example by breaking a frangible member as will be discussed below. The stop 206 may then be opened and the conveyance 110 and the downhole tools 122 may be run into the wellbore 112 (as shown in FIGS. 1 and 3D). For example, if the stop 206 is a valve, the valve may be opened, if the stop 206 is the BOP 114, the rams of the BOP 114 may be opened, thereby providing an opening for the conveyance 110 and/or the downhole tool 122 to move through.

The seal assembly 200 may remain in this actuated position as the conveyance 110 and downhole tools 122 run into the well to perform downhole operations in the wellbore 112. When the downhole operations are complete and/or the seal assembly 200 needs to be replaced, the conveyance 110 may run the downhole tools 122 up into the subsea equipment 108 until the downhole tools 122 pass the stop 206. The stop 206 may then be closed and the actuators 202 may be disengaged in order to allow the conveyance 110 and downhole tool 122 to pass through the stripper 102. As the downhole tool 122 passes through the stripper 102, the seal assembly 200 is taken out of the stripper 102 with the downhole tools 122 as shown in FIG. 3A.

A new seal assembly 200 may then be used on the next conveyance 110 to enter the wellbore 112. The new seal assembly 200 may be placed on the same type of conveyance 110 used previously, for example the coiled tubing, or may be used on a different type of conveyance 110, for example a slick line, a wire line, a different sized coiled tubing, and the like. Although shown as having two packer assemblies 204 and three actuators 202, it should be appreciated that the equipment replacement system 104 may have any number of packer assemblies 204 for example one, and any suitable number of actuators 202 for example one. Further, the location of the actuators 202 and the one or more packer assemblies 204 may be moved to any suitable location so long as the seal assembly 200 may sealingly engage the conveyance 110.

Figure 4A:
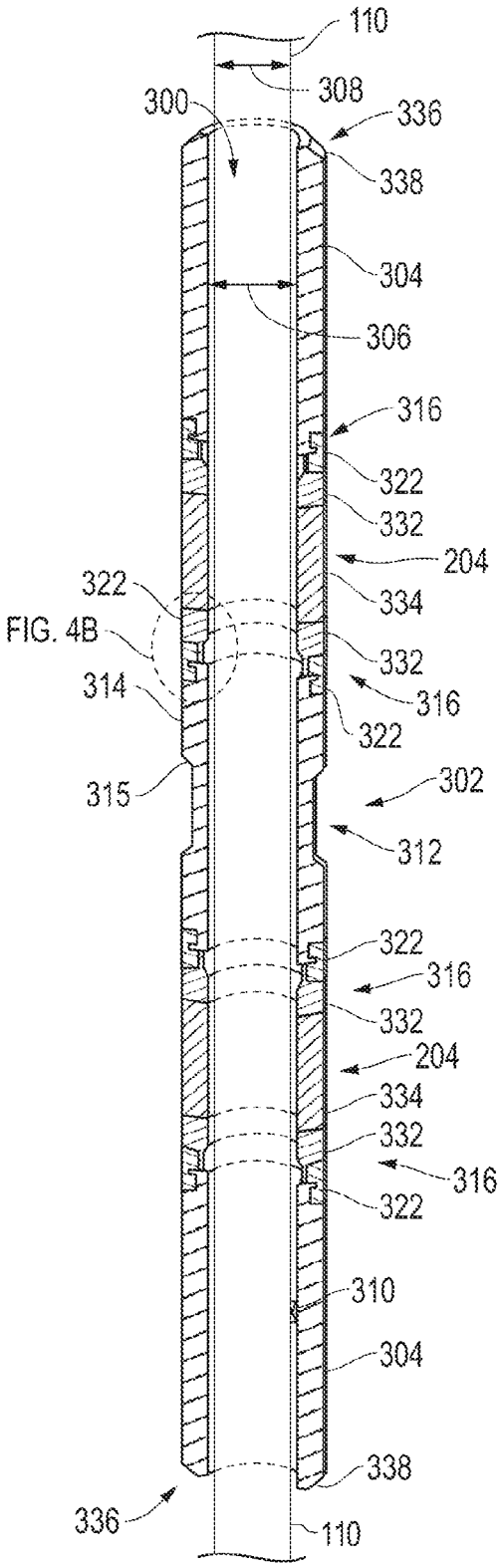
FIG. 4A shows a longitudinal, cross-sectional view of the seal assembly of FIG. 3A.

FIG. 4A shows a longitudinal, cross-sectional view of the seal assembly 200 of FIG. 3A taken along line B-B. As shown, the seal assembly 200 has a central bore 300, the one or more packer assemblies 204, a locator sleeve 302, and one or more actuation sleeves 304. The central bore 300 of the seal assembly 200 may have an inner diameter 306 that is slightly larger than the outer diameter 308 of the conveyance 110 to be run through the seal assembly 200. The inner diameter 306 of the seal assembly 200 may be changed for the type of conveyance 110 that is going to be used while keeping the same outer dimensions suited for the installed stripper 102 of the subsea equipment 108 (as shown in FIG. 1). Thus, in order to use a smaller or larger outer diameter conveyance 110, the seal assembly 200 may be changed to the seal assembly 200 having the inner diameter 306 corresponding to the smaller or larger conveyance 110.

A frangible member 310, as shown in FIG. 4A, may be secured to the conveyance 110 and the seal assembly 200 prior to, or during, installation of the seal assembly 200. The frangible member 310 may be any suitable device configured to secure the seal assembly 200 to the conveyance 110 while the seal assembly 200 is being run into and installed in the stripper 102 (as shown in FIG. 1). When the seal assembly 200 is installed into the stripper 102, the seal assembly 200 is prevented from moving along a longitudinal axis of the conveyance 110 relative to the stripper 102. By applying a large enough load to the conveyance 110, the frangible member 310 may be broken thereby allowing the conveyance 110 to move in the longitudinal direction while the seal assembly 200 stays in the actuated position in the stripper 102. The frangible member 310 is shown as coupling the actuation sleeve(s) 304 to the conveyance 110, but it may be located at any suitable location on the seal assembly 200. Further, there may be more than one frangible member 310. The frangible member 310 may be any suitable member such as a shear pin, a shear area, and the like. Although the seal assembly 200 is shown as being coupled to and disconnected from the conveyance 110 using the frangible member 310, any device suitable for temporarily securing the seal assembly 200 to the conveyance 110 may be used.

The locator sleeve 302 may be a locator sleeve 314 having a guide 312 (or an upset) on an outer surface of the locator sleeve 314. The guide 312 may be configured to be engaged by at least one of the one or more actuators 202 (as shown in FIGS. 3A-3D) as will be discussed in more detail below. As shown, the guide 312 has a reduced necked-down dual chamfer (or a chamfer) 315. The guide 312, may extend around the circumference of the locator sleeve 314, thereby allowing the guide 312 to be easily accessed by the one or more actuators 202. Although the guide 312 is shown as the reduced necked-down dual chamfer, it should be appreciated that the guide 312 may be any suitable device for being engaged by the one or more actuators 202 and/or positioning the seal assembly 200 in the proper location within the stripper 102, such as one or more indents, one or more grooves, one or more bosses and the like.

The locator sleeve 314 may be a substantially cylindrical sleeve with a similar inner diameter as the inner diameter 306 of the seal assembly 200. The locator sleeve 314 may have a sleeve connection member 316 at one or more of the ends of the locator sleeve 314. As shown in FIG. 4A, the locator sleeve 314 has the sleeve connection member 316 located at each end of the sleeve 314. The sleeve connection member 316 may allow the locator sleeve 314 to couple to the other devices in the seal assembly 200, such as the packer assemblies 204 and/or the actuation sleeve 304. The sleeve connection members 316 may couple directly to the packer assemblies 204 or to a connector segment 322.

Figure 4B:
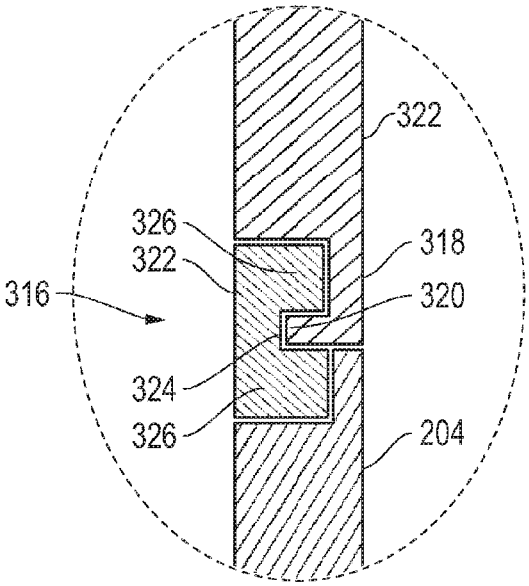
FIG. 4B shows a longitudinal, cross-sectional view of a portion of the seal assembly of FIG. 4A.

FIG. 4B shows the sleeve connection members 316 in greater detail. As shown, the sleeve connection members 316 may have a neck portion 318 and a shoulder 320. The neck portion 318 may be a narrower portion of the locator sleeve 314. The shoulder 320 may be a lip or ring that extends from the neck portion 318. The neck portions 318 may be configured to extend into the connector segment 322, or non-extrusion segment.

The locator sleeve 314, as shown in FIGS. 4A and 4B, may be constructed of any durable material capable of engaging the one or more actuators 202 and guiding the seal assembly 200 into the install position in the stripper 102 (as shown in FIGS. 3A-3D). The material may further allow the locator sleeve 314 to support a portion of the packer assemblies 204 along the seal assembly 200. The material may be brass, however, it may be any suitable material such as steel, metal, copper, ceramic, and the like.

The locator sleeve 314 may be coupled to and/or proximate the packer assemblies 204. As shown in FIG. 4A, connector segments 322 couple to the locator sleeves 314 and hold a portion of the packer assembly 204 in place. Each of the packer assemblies 204 may comprise one or more bushings 332, and a packer 334. The one or more bushings 332 as shown in FIG. 3A have an upper bushing and a lower bushing. The upper bushing may be located on one side of the packer 334 while the lower bushing may be located on the opposite side of the packer 334. The bushings 332 may be configured to secure the packer 334 in the seal assembly 200 and reduce the wear on the packer 334 during the life of the seal assembly 200. The bushings 332 may be constructed of any suitable material such as metal, ceramics, plastics and the like. The bushings 332 as shown may take any shape so long as they secure the packer 334 in the seal assembly 200.

The packer 334 as shown in FIG. 4A may be a ring having the central bore 300 therethrough. The packer 334 may be an elastomeric material configured to expand into sealing engagement with the conveyance 110 upon compression of the packer 334. Compression may be applied to the packer 334 via the one or more actuators 202 (as shown in FIGS. 3A-3D) as will be discussed in more detail below.

The one or more actuation sleeves 304, as shown in FIG. 4A, may be a substantially cylindrical sleeve with a similar inner diameter as the inner diameter 306 of the seal assembly 200. The one or more actuation sleeves 304 may be configured to engage the one or more actuators 202 (as shown in FIGS. 3A-3D). The actuators 202 may motivate the actuation sleeves 304 thereby actuating the packers 334, as will be discussed below. The one or more actuation sleeves 304 may be constructed of a similar material as the locator sleeve 314. The one or more actuation sleeves 304 may engage a portion of the packer assembly 204 in order to actuate the packer 334. The one or more actuation sleeves 304 may couple to and/or engage the packer assembly 204 in any suitable manner. In one example, the one or more actuation sleeves 304 has the one or more sleeve connection members 316 that connect the sleeve 304 to the packer assembly 204.

The one or more actuation sleeves 304 may have an actuation end 336. The actuation end 336 may be configured to engage the actuator 202 (as shown on FIGS. 3A-3D), as will be discussed in more detail below. The actuation end 336, as shown in FIG. 3A, has a tapered end 338. The tapered end 338 may be configured to engage the actuators 202, thereby securing the one or more actuation sleeves 304 and seal assembly 200 in the install position.

The connector segment 322 may be configured to secure the linearly aligned portions of the seal assembly 200 to one another. As shown in FIGS. 4A and 4B, the connector segment 322 may be a ring that surrounds the seal assembly 200. The ring may have a groove 324 configured to envelope, or partially house the shoulder 320 of the locator sleeve 314. The groove 324 may have an upset 326 on either side that extends into a portion of the locator sleeve 314 and/or the next seal assembly portion, in this case the packer assembly 204. When assembled, the shoulder 320 may engage the groove 324 walls thereby preventing linear movement of the connector segment 322 relative to the locator sleeve 314.

Figure 4C:
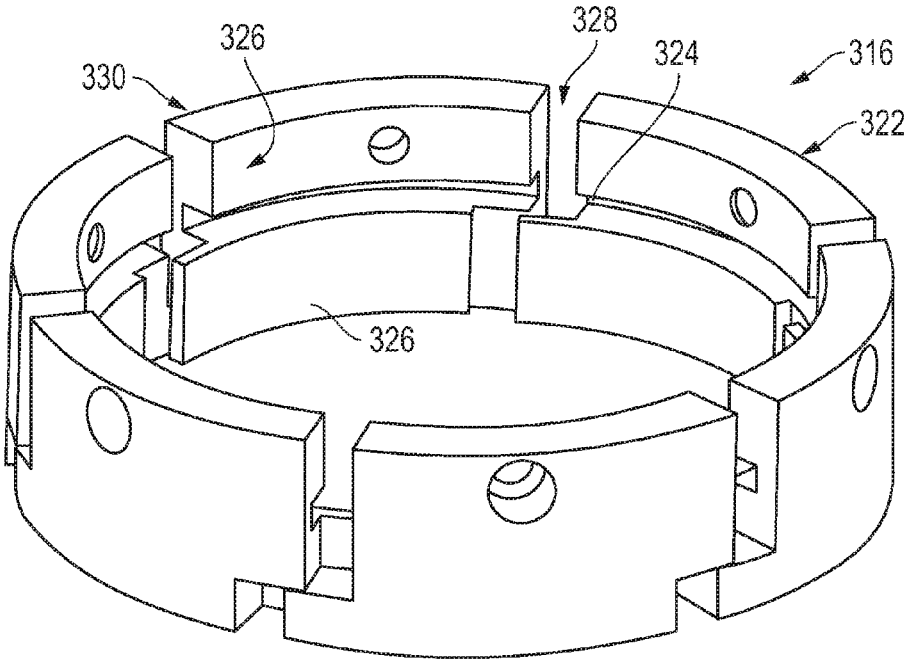
FIG. 4C shows a schematic view of a connector segment of the seal assembly of FIG. 3A.

FIG. 4C shows another connector segment (or non-extrusion ring) that may be used as the connector segment 322 of FIGS. 4A and 4B. This connector segment 322 may be configured to expand and contract its diameter based on the size of the seal assembly 200 being used. To this end, the alternative connector segment 322 may have one or more joints 328 between a plurality of ring segments 330. The joints 328 may allow the ring segments 330 to move toward and away from one another and thereby allowing the connector segments 322 to expand or contract in diameter.

Figure 5A:
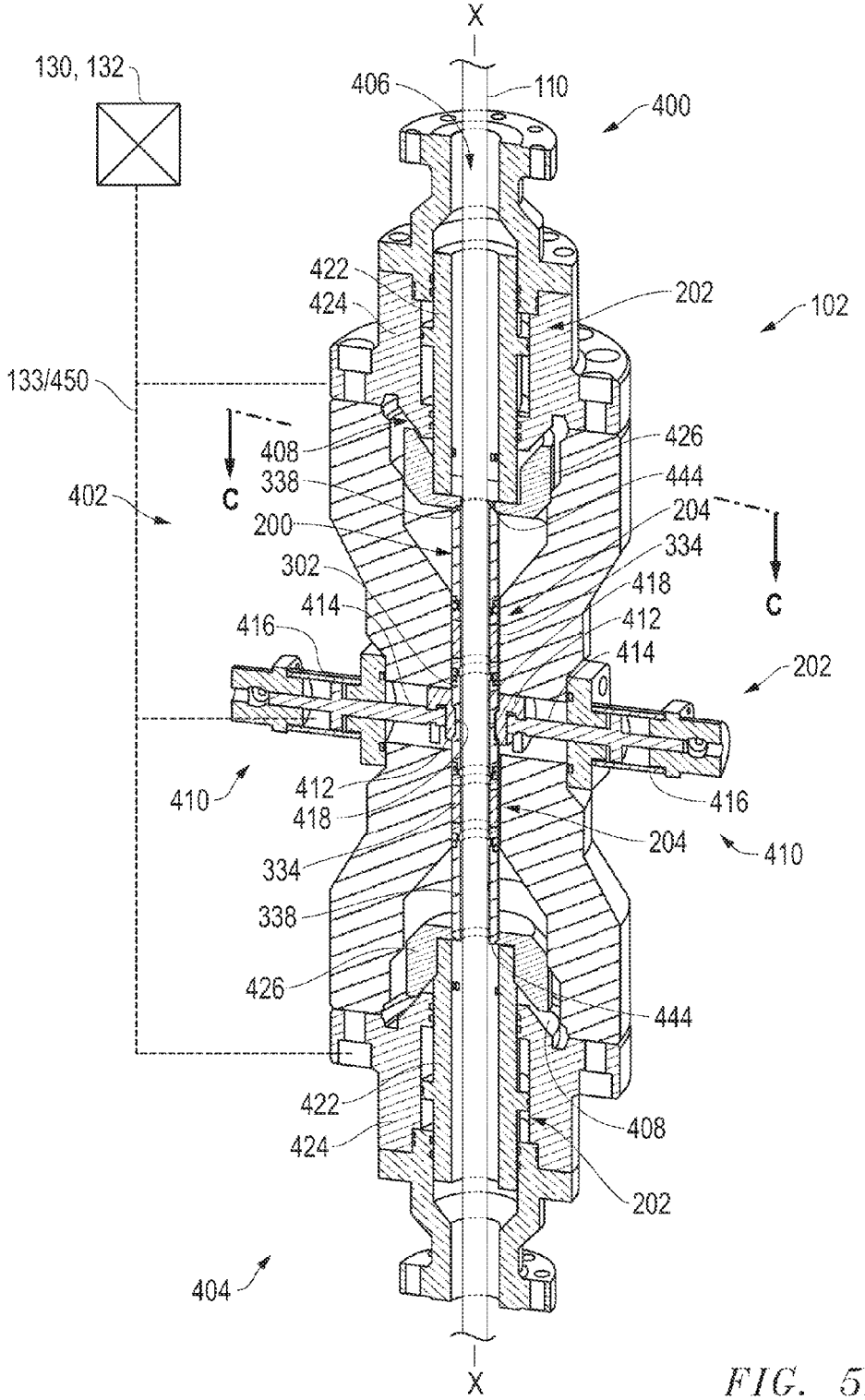
FIG. 5A shows a longitudinal, cross-sectional view of the stripper of FIG. 2 having the seal assembly of FIG. 4A therein, the seal assembly having a locator sleeve, a packer actuator, and guide in the engaged position.

FIG. 5A shows a cross-sectional view of the stripper 102 of FIG. 2 taken along line A-A. The stripper 102 has the seal assembly 200 in the install position therein. The stripper 102 as shown may have an injection portion 400, a seal assembly portion 402, and a tool connection portion 404. The injection portion 400 may serve as the entry and/or exit point for the conveyance 110 on the upstream side of the stripper 102. The injection portion 400 may be configured to connect to a tool such as the conveyance delivery system 120 (as shown in FIG. 1). The conveyance delivery system 120 may deploy the conveyance 110 into the stripper 102.

The tool connection portion 404 may be configured to secure the stripper 102 to another tool, and/or pipe, downstream of the stripper 102, for example the BOP 114 (as shown in FIG. 1) and/or the stop 206 (as shown in FIG. 3A-3D). The tool connection portion 404 as shown is a flange configured to bolt onto the tool, although it should be appreciated that any connection may be used.

The seal assembly portion 402 of the stripper 102 may comprise a body with the actuators 202 therein and a stripper central bore 406 therethrough. The stripper central bore 406 may be configured to allow the conveyance 110 with the attached seal assembly 200 to enter and pass through the stripper central bore 406 when the stripper 102 is in an open position (as shown in FIG. 3A). The actuators 202 in the stripper 102 secure the seal assembly 200 within the stripper central bore 406.

The seal assembly portion 402 of the stripper 102, as shown in FIG. 5A, has two packer actuators 408 and two locator actuators 410 (or middle actuators). The locator actuators 410 may engage the locator sleeve 302 in order to axially align the seal assembly 200 in the stripper 102. Each of the locator actuators 410 may have an engager 412, a piston 414 and a cylinder 416. The piston 414 and the cylinder 416 may operate like a standard piston and cylinder in order to axially extend and retract the piston 414, and thereby the engager 412. The engager 412 is configured to engage the locator sleeve 302 of the seal assembly 200.

Figure 5B:
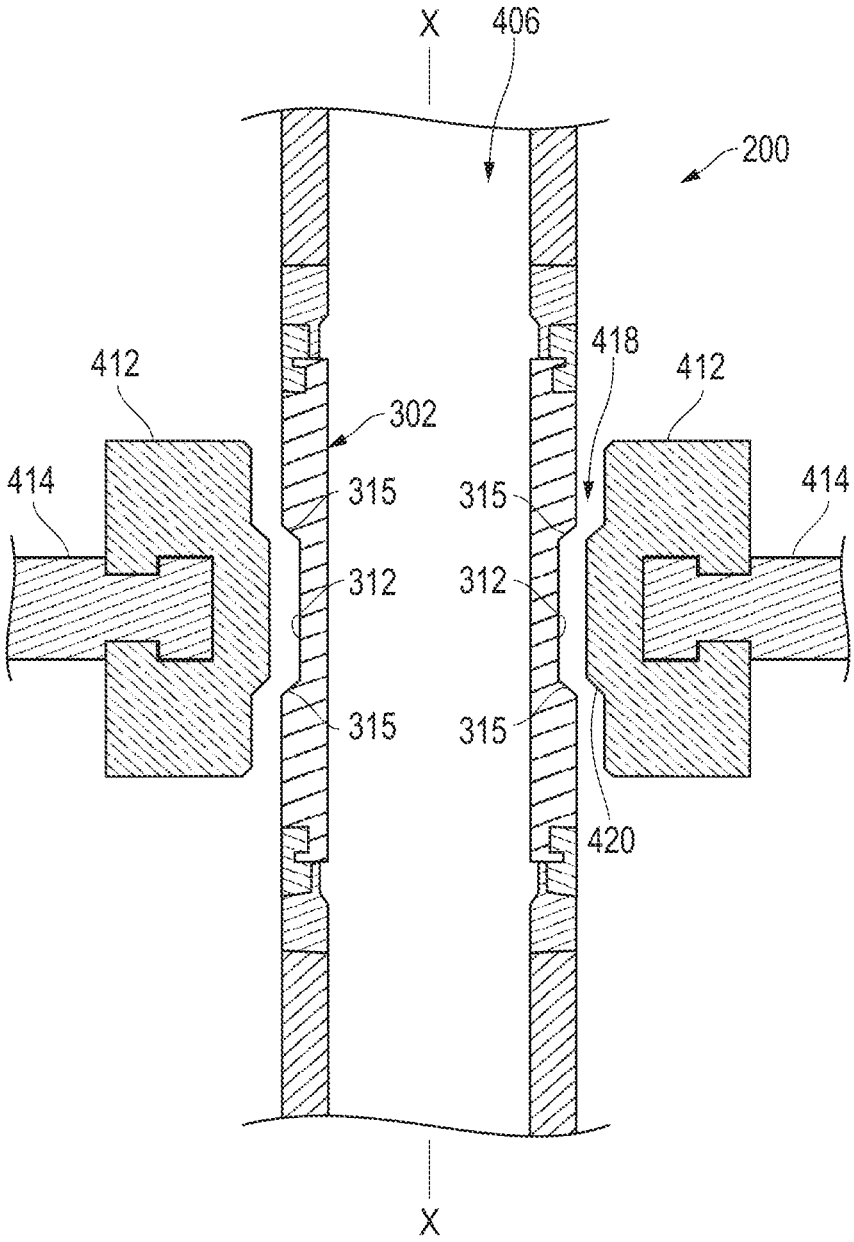
FIG. 5B shows a schematic view of a portion of the stripper of FIG. 5A with the guide in the disengaged position.

As shown in FIG. 5B, the engager 412 may have an upset 418 configured to mate with the guide 312 of the locator sleeve 302. The upset 418 may have a sloped edge 420 (or beveled edge) configured to engage the dual chamfer of the guide 312. As the sloped edge 420 of the engager 412 engages the dual chamfer 315 of the guide 312, the sloped edge 420 may align the seal assembly 200 both axially along an X-X axis of the seal assembly 200 and centrally within the central bore 406. Although the guide 312 and the engager 412 are described as having the dual chamfer 315 and the sloped edges 420, the guide 312 and the engager 412 may have any suitable form capable of locating the seal assembly 200 at the install position within the stripper 102, as shown in FIG. 5A.

The packer actuators 408 may be configured to sealingly engage the packer 334 against the conveyance 110. FIG. 5A shows two packer actuators 408 although there may be any suitable number of packer actuators 408, such as one or more. The operation of the upper of the packer actuators 408, as shown in FIG. 5A will now be described in detail. The packer actuator 408 may have a packer piston 422 and a packer cylinder 424 configured to move a motivator 426. The packer piston 422 and the packer cylinder 424 may operate like a standard piston and cylinder in order to axially extend and retract the packer piston 414, and thereby the motivator 426. As the packer piston 414 moves the motivator 426 in the axial direction, the motivator 426 may further move in the radial direction in order to selectively allow the seal assembly 200 to pass through the central bore 406.

Figure 5E:
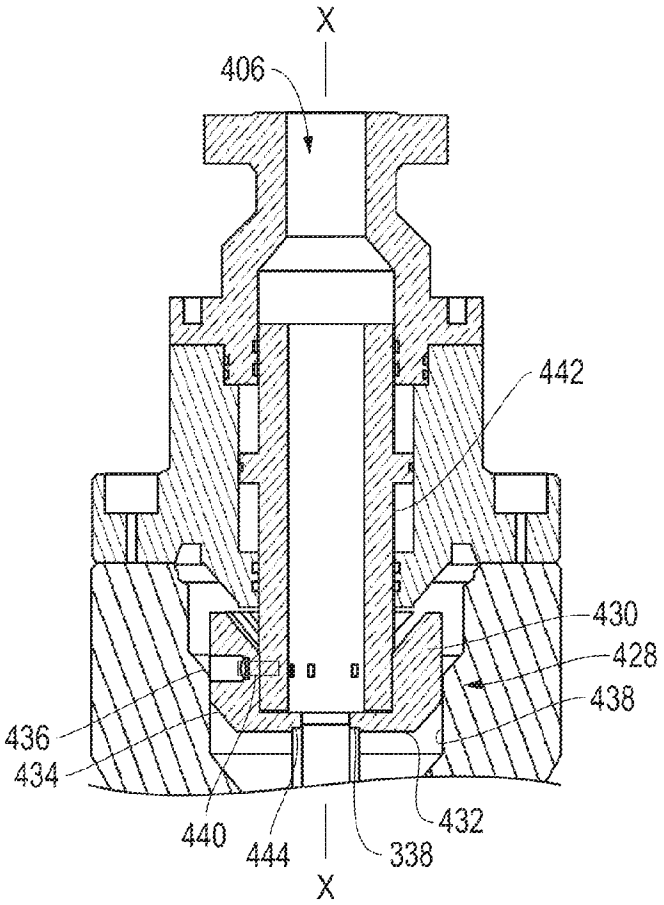
FIG. 5E shows the packer actuator of FIG. 5C in an actuated position.
Figure 5C:
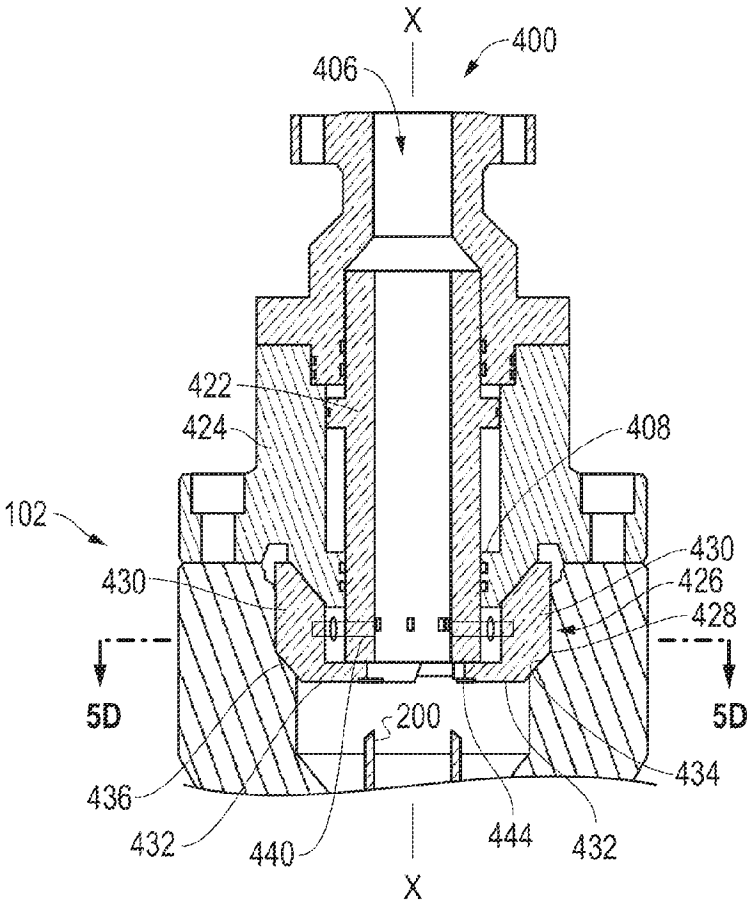
FIG. 5C shows a longitudinal, cross-sectional view of the packer actuator of the stripper of FIG. 5A in an un-actuated position.
Figure 5D:
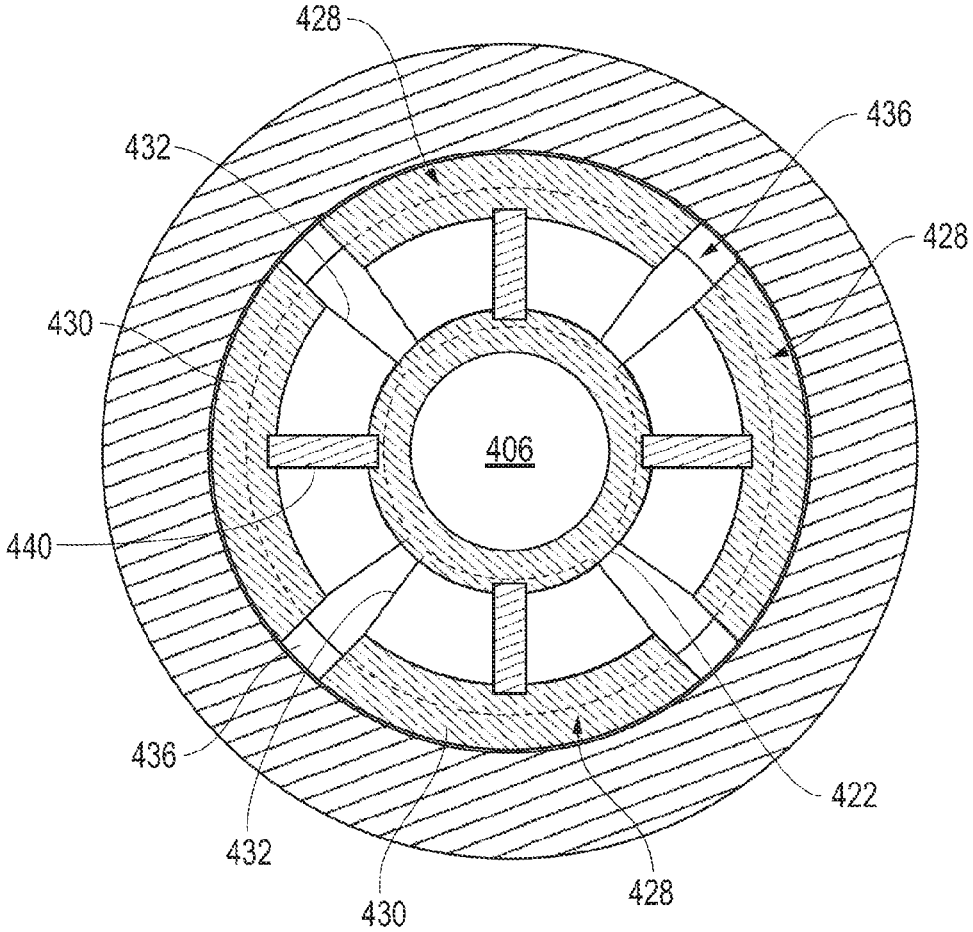
FIG. 5D shows a horizontal, cross-sectional top view of the packer actuator of FIG. 5C (shown in full).

FIGS. 5C and 5E are longitudinal, cross-sectional views of the injection portion 400 of the seal assembly 200. As shown in FIG. 5C, the packer actuator 408 is in an unactuated position. In the unactuated position, the motivator 426 does not block movement of the seal assemblies 200 (as shown in FIG. 5A) into the central bore 406 of the stripper 102. The motivator 426 may be one or more slip portions 428. FIG. 5D shows a horizontal, cross-sectional top view taken along line C-C (shown in whole) of the motivator 426 of FIG. 5A having four slip portions 428 located at 90° from one another. Each of the slip portions 428, as shown in FIGS. 4C and 4D may have a slip body 430 and a slip central bore end 432. The slip body 430 may have a slip surface 434 configured to engage a bowl 436. As the motivator 426 is moved axially, the bowl 436 will engage the slip surface 434, thereby moving the motivator 426 radial inward or outward.

FIGS. 5C and 5D show the one or more slip portions 428 in the unactuated position wherein the piston 422 is in a retracted position and the slip body 430 is proximate a first interior wall of the packer actuator 408. As the piston 422 moves axially toward the actuated position (as shown in FIG. 5E), the slip surface 434 travels along the bowl 436. The bowl 436 moves each of the one or more slip portions 428 radially inward as the piston 422 moves the slip portions axially down the bowl 436. As the slip portions 428 move radially inward, the slip central bore end 432 moves into the central bore 406 of the stripper 102 as shown in FIG. 4E.

The slip portions may move radially inward until the slip portions 426 reach a seal assembly engagement position wherein the slip central bore ends 432 are positioned for engaging seal assembly 200 and/or actuating the packer 334 (as shown in FIG. 5A). In the seal assembly engagement position, the slip body 430 may be located between an outer piston surface 442 and a second interior wall 438, as shown in FIG. 5E. The second interior wall 438 may be located proximate the bowl 436 and may have a substantially cylindrical wall, or wall substantially parallel to the central axis X-X. With the slip body 430 located between the second interior wall 438 and the outer piston surface 442, the piston 422 may move the motivator 426 axially without further moving the slip portions 430 radially in order to actuate the packer 334 (as shown in FIG. 5D).

A motivator connector 440 may couple the motivator 426 to the piston 422. The motivator connector 440 may be any suitable device that allows the motivator 426 to move axially with the piston while allowing the motivator 426 to move radially relative to the piston 422. As shown, the motivator connector 440 is a pin connector coupled to the piston 422 and the motivator 426.

The slip portions 430 of the motivator 426 may have a seal assembly engagement edge 444. The seal assembly engagement edge 444 as shown in FIGS. 5A and 5C-5E is a sloped surface configured to engage the tapered end 338 of the actuation sleeve 304 of the seal assembly 200. As the tapered end 338 of the seal assembly 200 is engaged by the seal assembly engagement edge 444, the seal assembly 200 may be further aligned and secured along the central bore 406 of the stripper 102. Although the seal assembly engagement edge 444 is shown as a sloped edge configured to engage the tapered edge 338 of the seal assembly, it should be appreciated that any arrangement for securing the seal assembly 200 to the actuators 202 within the stripper 102 may be used. The continued movement of the motivator 426 against the actuation sleeve 304 may actuate the one or more packers 334 into sealing engagement with the conveyance 110.

The system may also include the hydraulic system, or a plurality of hydraulic operators which drive or move the one or more actuators 202, the BOP 114 and/or the stop 206 (as shown in FIGS. 1 and 3A-3D). One or more hydraulic lines 450 (as shown in FIG. 5A) may be supplied by one or more hydraulic systems. The hydraulic systems may have any suitable device and/or devices for controlling the one or more actuators 202 such as at least one pump, pressure gauges, relief valves, and the like. The hydraulic system and/or the one or more actuators 202 may be in communication with the controllers 130 and/or 132 in order to control the movement of the actuators 202 automatically and/or remotely. Although the one or more actuators 202, the BOP 114 and/or the stop 206 are shown as being operated by the hydraulic system it should be appreciated that any suitable system and/or device and/or combination thereof may actuate the these components such as one or more servos, a pneumatic system, a mechanical actuator and the like.

Figure 6:
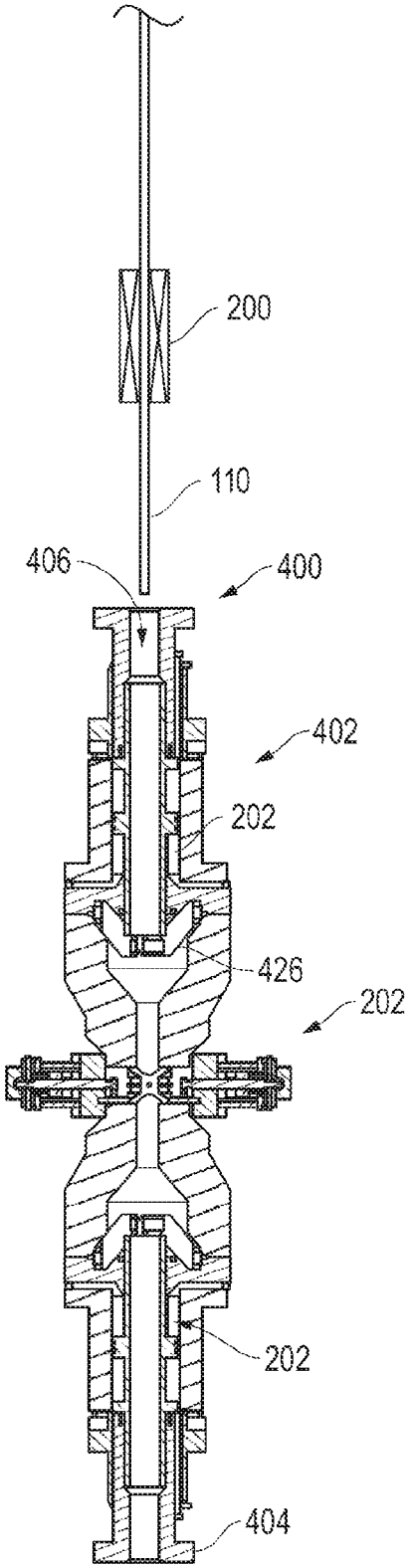
FIG. 6 shows a longitudinal, cross-sectional view of an upper portion of the subsea assembly of FIG. 2.
Figure 8A:
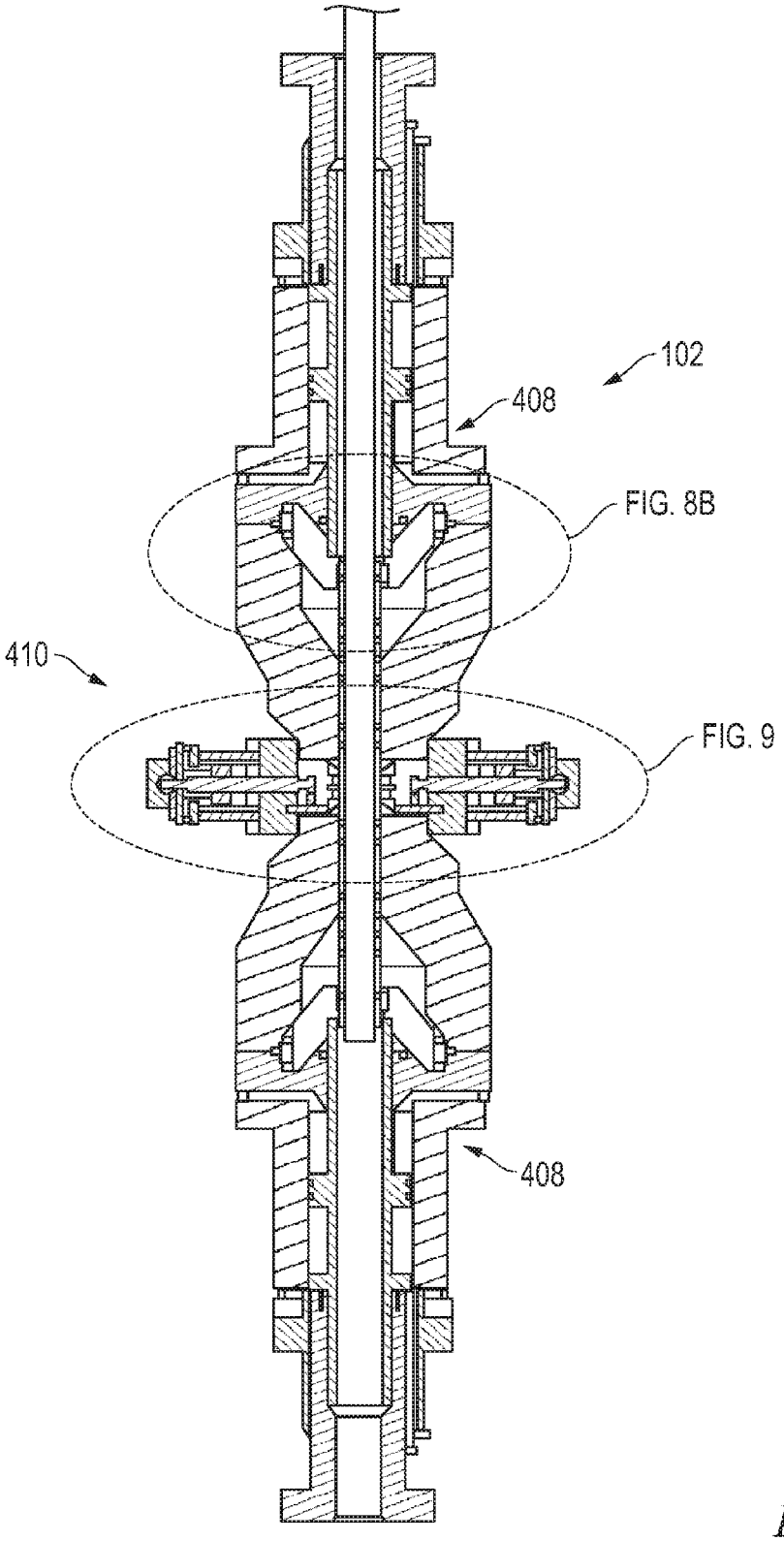
FIG. 8A shows a longitudinal, cross-sectional view of the stripper of FIG. 2.
Figure 8B:
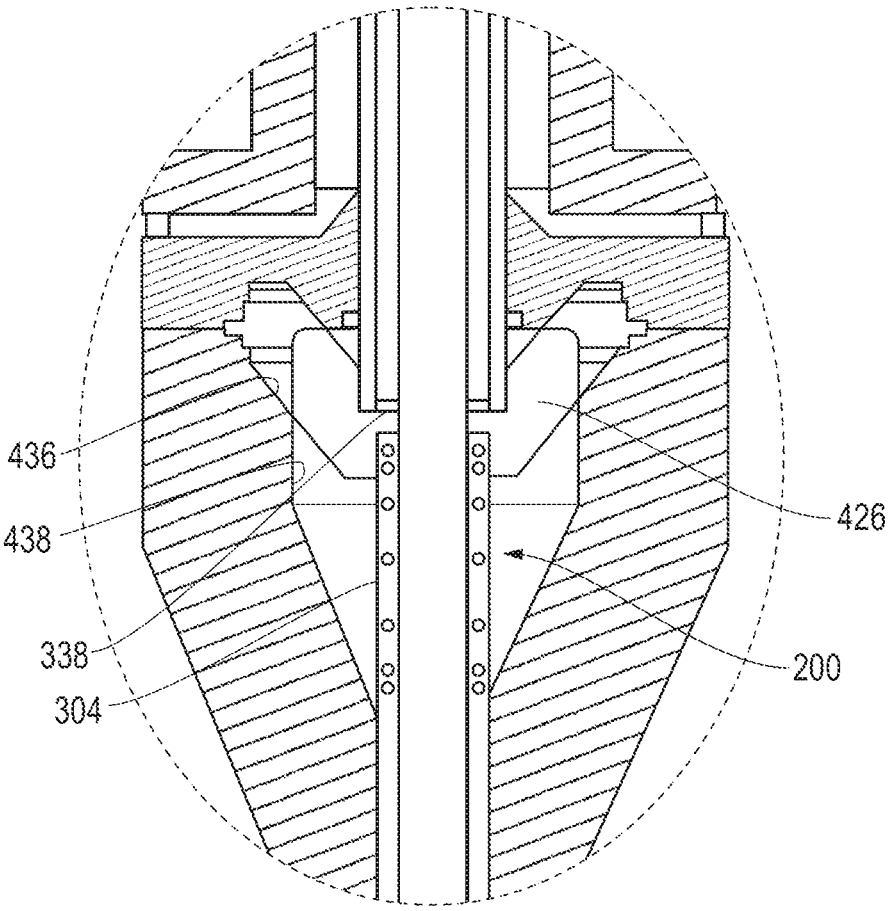
FIG. 8B shows a detailed view of a portion of the stripper of FIG. 8A, depicting the packer actuator.
Figure 9:
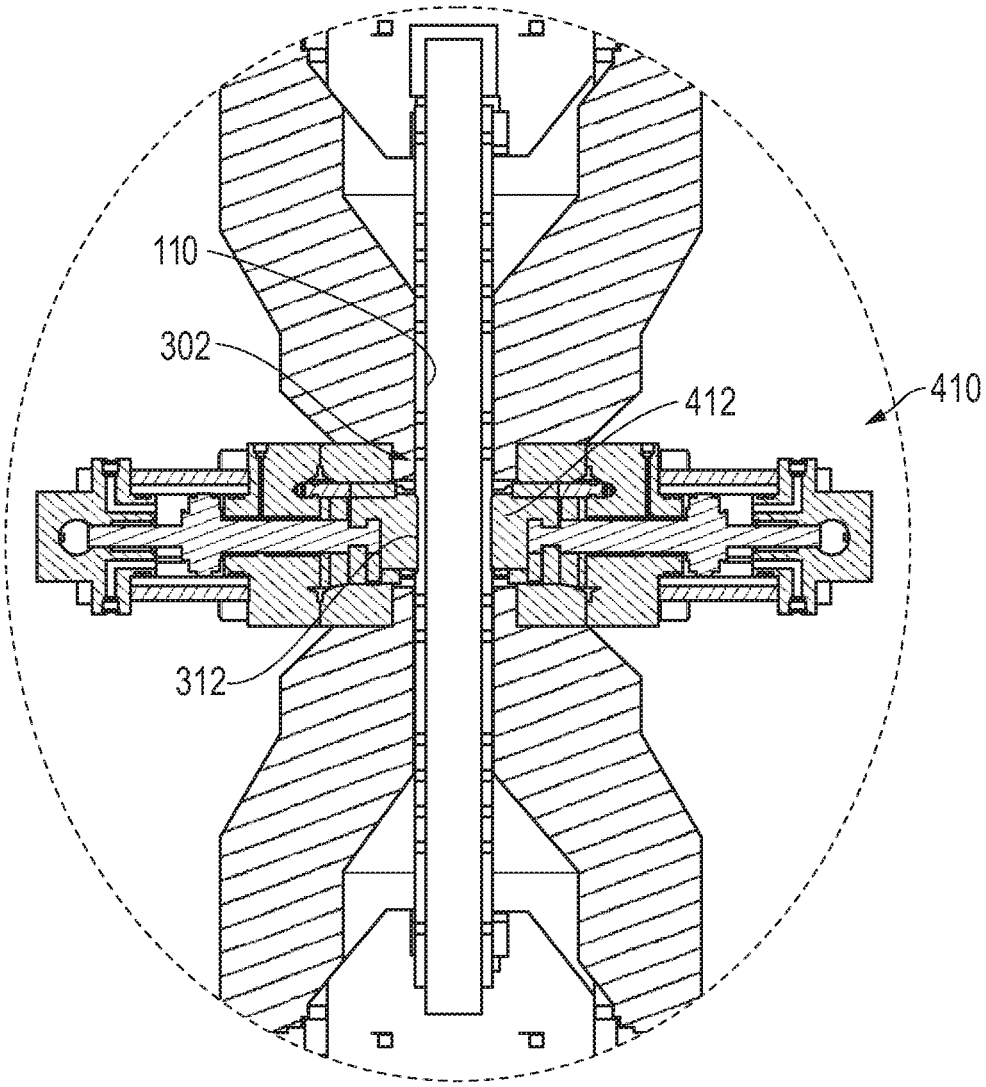
FIG. 9 shows a detailed view of a portion of the stripper of FIG. 8A, depicting the locator sleeve and guide.
Figure 10:
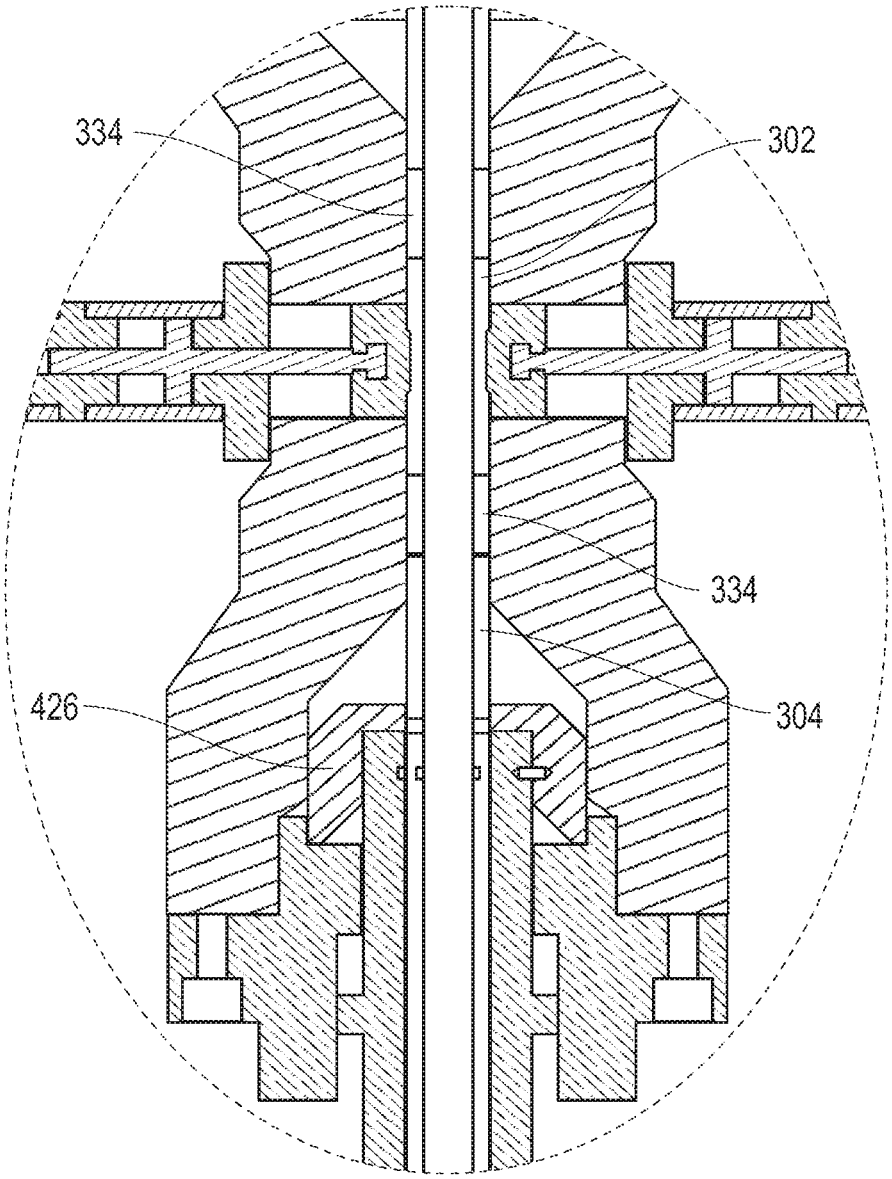
FIG. 10 shows a longitudinal, cross-sectional view of a portion of the stripper of FIG. 2.

FIGS. 6-12C show the operation of the equipment replacement system 104 of FIG. 2 in greater detail. These illustrations show the stripper 102 (or the unit) first in an open state allowing the conveyance 110 and the downhole tools 122 (or the tool string) to pass through the stripper 102 as shown in FIG. 6, and then in a closed state with the seal assembly 200 (or the brass/packer assembly) in place as shown in FIG. 8A and being actuated as shown in FIG. 10. Illustrated also is the sequence of the conveyance 110 as it deploys the packers 334 (or the consumable packers and brass) through the stripper 102 and prepares to position them for further deployment of the downhole tools 122, or the tool string as shown in FIG. 11A. The consumable components (brass bushings and packer elements) of the seal assembly 200 may be joined together to allow their deployment via the conveyance 110 (or the tool string) as shown in FIGS. 6-12C. This may be accomplished by using a bonding agent or by incorporating the brass into the molding of the packers, or by any suitable method including those described herein. In either configuration with the dual packing elements, the consumables will be configured as shown and described below. The packers 334 (or the packing elements) may be energized independently of one another. In an embodiment shown in FIG. 8B, the locator actuator 410 (or the middle actuators) locate the seal assembly 200 (or the brass and packers) while the motivators 426 of the packer actuators 408 (or the upper and lower locking sleeves) secure around the tapered end 338 (or the tapers of the actuation sleeves) 304 (or the upper and lower brass components). At this time, the upper or lower piston can be actuated to energize the packing element the operator chooses to use.

Figure 7A:
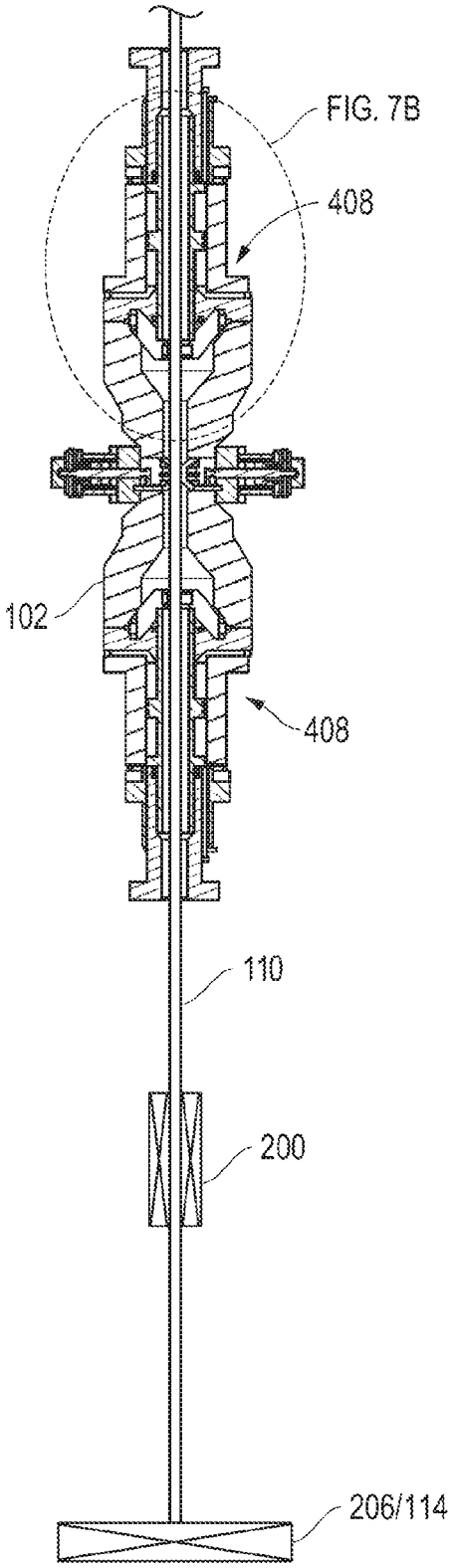
FIG. 7A shows a longitudinal, cross-sectional view of a lower portion of the subsea assembly of FIG. 2.
Figure 7B:
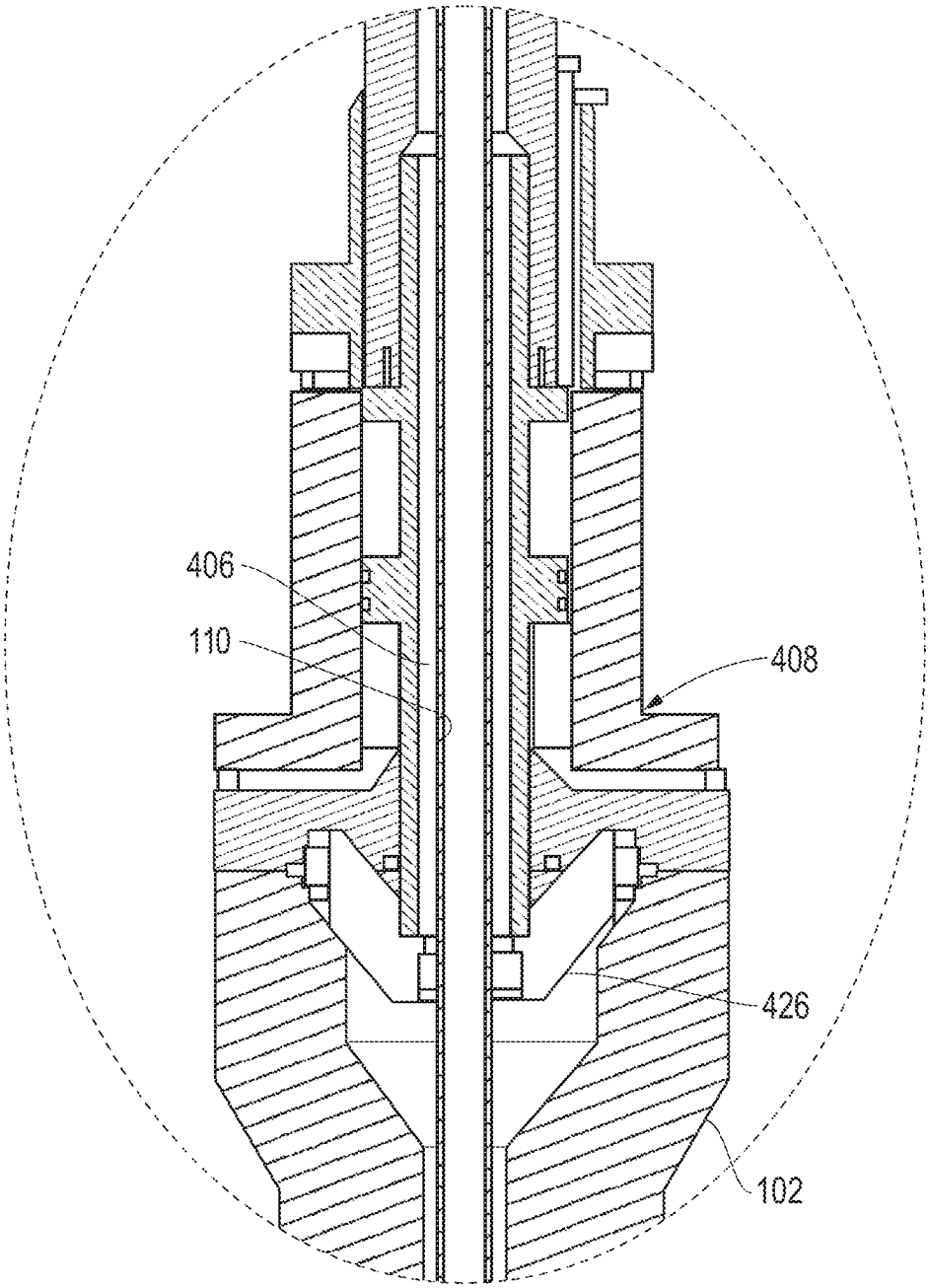
FIG. 7B shows a detailed view of a portion of the packer actuator of FIG. 7A.

FIG. 6 shows a cross-sectional view of the stripper 102 of FIG. 2 in the open position. In the open position, the actuators 202 are all unactuated, or retracted, thereby unobstructing the stripper central bore 406. The conveyance 110 with the seal assembly 200 may then be run into the stripper 102. To position the seal assembly 200 (or the brass and packer elements) into the stripper 102 unit, the seal assembly 200 components are lowered on the conveyance 110 (or tool string) until they reach a predetermined position. This position may be made known to the operator via the weight string indicator top-side when contact is made with the closed rams on the BOP 114 and/or the stop 206 as shown in FIG. 7A. In the case of the stripper 102 having a dual-packer design, the upper actuators (or the uppermost of the packer actuators) 408 may then be closed and the conveyance 110 (or tool string) may be pulled against the closed motivator 426 (or upper rams). The uppermost packer actuator 408 may be actuated in order to move a portion of the motivator 426 into the stripper central bore 406, as shown in FIG. 7B. In this position, the motivator 426 may allow the conveyance 110 to move axially within the stripper 102 but will engage the seal assembly 200.

The conveyance 110 may then be pulled toward the closed motivator 426 (or upwards) until the seal assembly 200 engages a portion of the uppermost packer actuator 408, as shown in FIGS. 8A and 8B. The locator actuator 410 and the lowermost packer actuator 408 (or the middle and bottom rams respectively) are then closed to contain the seal assembly 200 (or the components) in place. Once the positioning is detected, the uppermost of the packer actuator 408 (or the upper piston) is actuated to the closed position and the seal assembly 200 (or the components) may be pulled against the uppermost motivator 426 (or the upper assembly). The actuators and lower piston are then closed around the seal assembly 200 (or the components) to hold their position. In both scenarios, a shearing function may then occur using either a shear pin, a frangible member and/or a slotted bushing. The bushings and packers may be properly in place with the BHA being free to travel downward.

The seal assembly 200 engaging the closed motivator 426 may be detected as a force increase in the conveyance 110 by the operator, and/or the controllers 132 and/or 134. Upon detection of the seal assembly 200 engaging the uppermost actuator 408, movement of the conveyance 110 may be temporarily stopped until the seal assembly 200 is in the install position.

With the seal assembly 200 engaged with the uppermost actuator 408, the locator actuator 406 may be actuated to align the seal assembly in the install position, as shown in FIG. 9. The seal assembly 200 may be configured wherein the locator sleeve 302 is substantially aligned with the locator actuators 410 when the seal assembly 200 is engaged with the uppermost actuator 408. As the locator actuator 410 actuates, the engager 412 engages the guide 312. The engager 412 moves the guide 312, and thereby the seal assembly 200, into the install position as the engager 412 moves into engagement with the guide 312. The lowermost actuator 408 may at this time still be in the unactuated position as shown in FIG. 9. Although the lowermost actuator 408 is shown as being unactuated while the locator actuator 410 engages the locator sleeve 302, it should be appreciated that the lower actuator 408 and the locator actuator 410 may be actuated simultaneously.

Figure 11A:
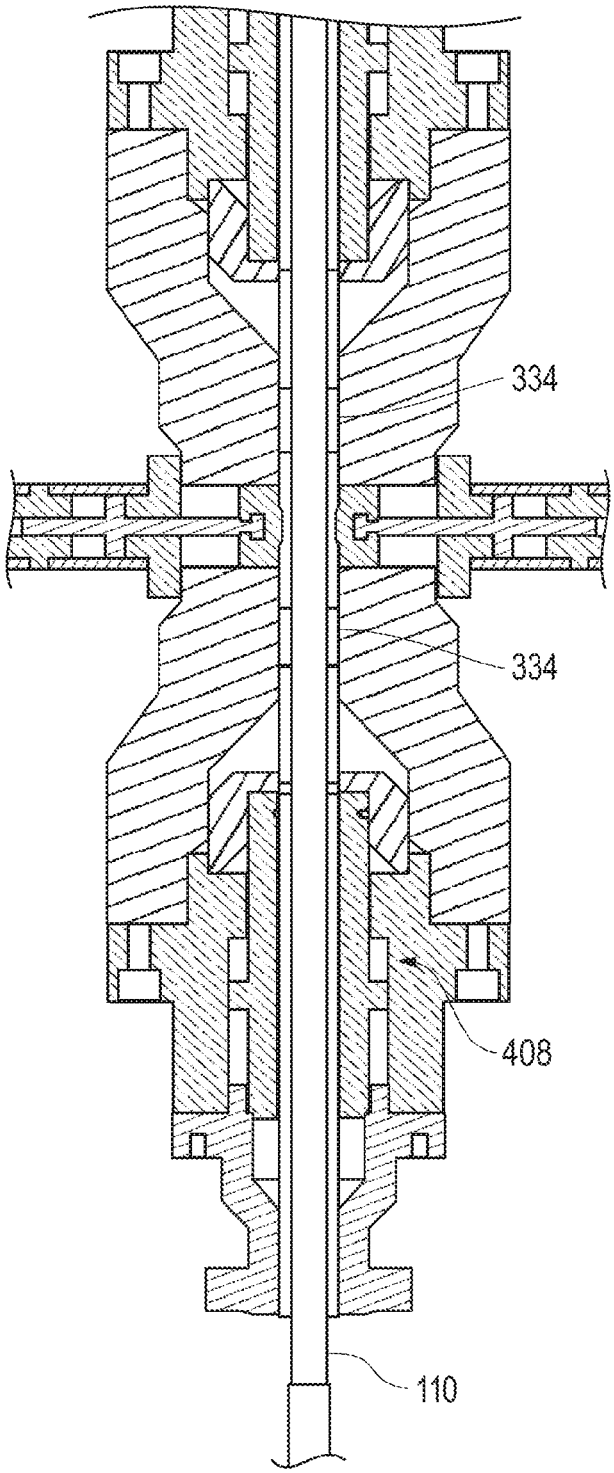
FIG. 11A shows a longitudinal, cross-sectional view of the stripper of FIG. 2.

The lowermost of the two packer actuators 408 may then be actuated until its corresponding motivator 426 engages the actuation sleeve 304 of the seal assembly 200, as shown in FIGS. 10 and 11A. The seal assembly 200 is then located in the install position. The seal assembly 200 may then be actuated. The two packer actuators 408 may actuate the seal assembly by compressing the packers 334 between the actuation sleeve 304 and the locator sleeve 302. This compression will force the elastomeric packer 334 into a sealing engagement with the conveyance 110 as shown in FIG. 11A. With the seal assembly 200 in the installed position, the packers 334 are sealingly engaged with the conveyance 110.

Note the tapers (the seal assembly engagement edge 444, and/or the tapered end 338 as shown in FIG. 5A) on both models and how the locking guides (or the motivator 426) are forced open upon the primary (or upper) piston's (the uppermost packer actuator 408) retraction and then closed around the corresponding chamfers on the upper brass (or tapered end 338 of the seal assembly 200). Again, the actuators 202 hold the seal assembly 200 (or the consumable assembly) in place to allow energizing of one of the packers 334, or other packing elements.

The seal assembly 200 (or the consumables) are first located and secured in the stripper 102 assembly. At this time force is put on the conveyance 110 (and/or the tool string) by the injector 120 (as shown in FIG. 1) resulting in the shearing/release of the conveyance 110 and/or the downhole tools 122 (or the BHA) from the seal assembly 200 (or the consumable package) where it continues its descent. This may be made possible due to the lower portion of the seal assembly 200 (or the consumable assembly package) that contains a "necked-down" shear area, as shown in FIG. 11B.

Figure 11B:
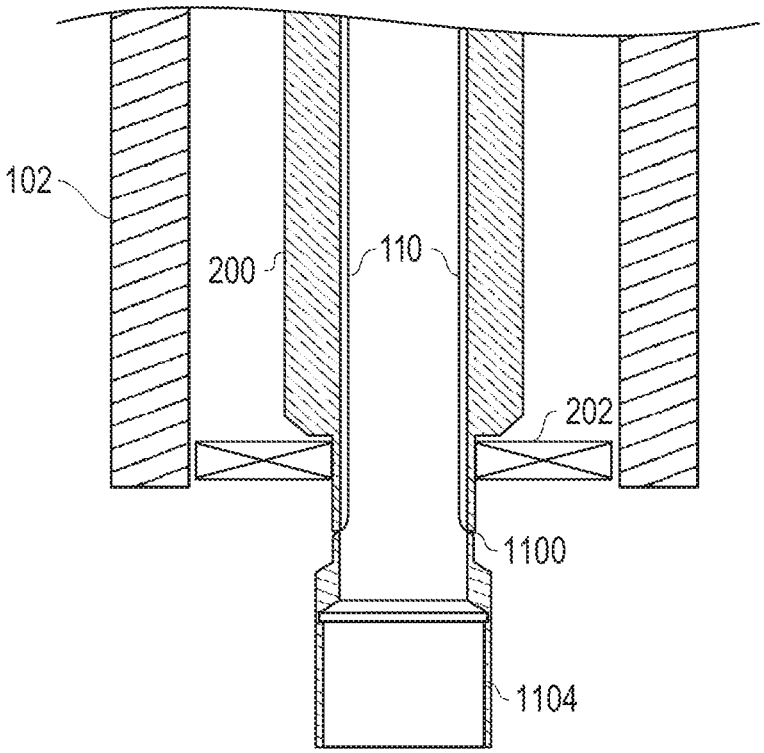
FIG. 11B shows a schematic view of a portion of the seal assembly of FIG. 3A, depicting a frangible member thereof.

The conveyance 110 may then be moved in order to break the frangible member 310, and/or 1100 in FIGS. 4A and 11B, and thereby uncouple the conveyance 110 from the seal assembly 200. As discussed above, the frangible member may be a pin coupling the conveyance 110 to the seal assembly 200. Further, the frangible member may be a neck-down shear area 1100 of the conveyance 110 at an end of the seal assembly 200 as shown in FIG. 11B. Thus, the frangible member may be a small neck of the seal assembly 200, as shown on the lower side of the seal assembly 200. When force is applied to the seal assembly 200 with the lower actuators 202 engaged with the seal assembly 200, the neck-down shear area 1100 will break, thereby allowing the conveyance to move relative to the stripper 102. The stop 206 and/or BOP 114 (as shown in FIGS. 1 and 2A-2D) may then be opened to allow conveyance 110 and/or the downhole tools 122 to enter and perform operations in the wellbore 112.

Figure 11C:
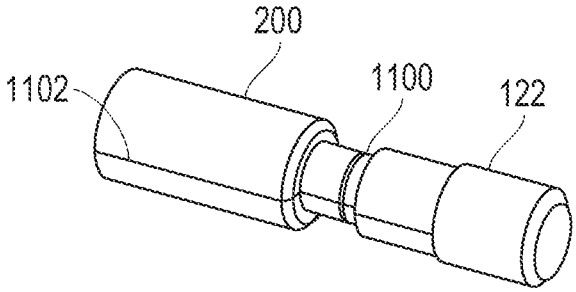
FIG. 11C shows a schematic view of the seal assembly of FIG. 11B.

FIG. 11C depicts a schematic perspective view of the seal assembly 200 and the conveyance 110 coupled to one another. The seal assembly 200 as shown has a split 1102 design. The split 1102 design may allow two or more separate portions of the seal assembly to be constructed and put together easily around the conveyance 110. The split assembly may enable the operator to quickly remove the seal assembly and the downhole tools 122 from the conveyance 110.

Regarding design of the packing element and brass bushings, a split-packer or a solid, non-split packer may be used for this application. The solid packer allows for ease of manufacturing (and potentially less cost), but may result in the BHA connector having to be disconnected from the tool string each time the consumables are removed. This split design may be used throughout the seal assembly 200 (or the consumable package) to allow for ease of installation around the coil tubing and/or the conveyance 110. Once the split halves are situated around the coil tubing, they may be fastened together prior to deploying. The split design may also allow for ease in the retrieval process.

Once downhole operations are complete, the conveyance 110 and the seal assembly 200 may be removed from the stripper 102. In removing the seal assembly 200 (or the consumables), the conveyance 110 with the downhole tools 122 (or tool string) may be brought up to the lower of the actuators 202 (or the actuators/subassembly). Actuators 202 and/or the pistons 414/422 may then be opened and the seal assembly 200 (or the components) may rest on a BHA connector 1104 as shown in FIG. 11A. The seal assembly 200, having brass and packer elements, may then be brought to the surface once the job is complete or for redressing.

Once the job is complete the seal assembly 200 (or the consumable package) may be returned to surface. The conveyance 110 with the downhole tools 122 (or the tool string) ascends through the BOP 114 and tags off on the bottom of the retrievable stripper 102. The packer actuators 408 (or the upper and lower pistons) may be actuated to the open position as are the locator actuators 410; there is no protocol necessary regarding the sequence for opening these. Once the upper, lower pistons and actuators are in the open position, the seal assembly 200 (or the consumable assembly) comes to rest on the BHA. At this time, it may continue its ascent through the stripper 102 with the consumables on the tool string.

Figure 12A:
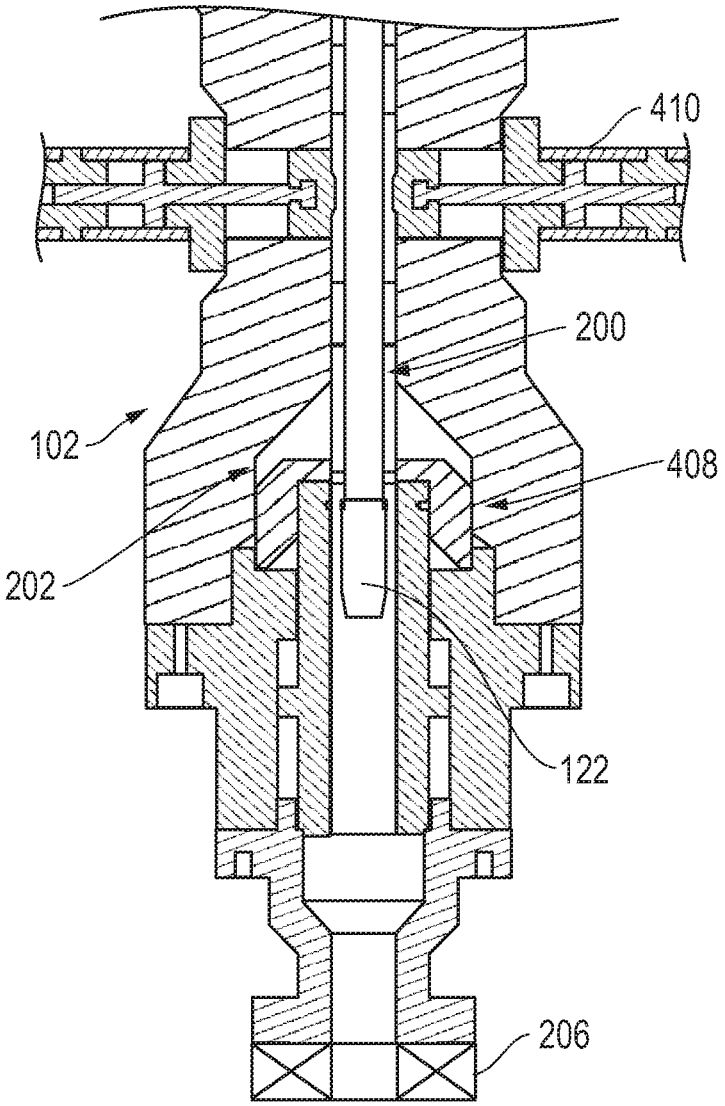
FIGS. 12A-12C show partial cross-sectional views of portions of the subsea assembly of FIG. 2, depicting the operation of the stripper and equipment replacement system.
Figure 12B:
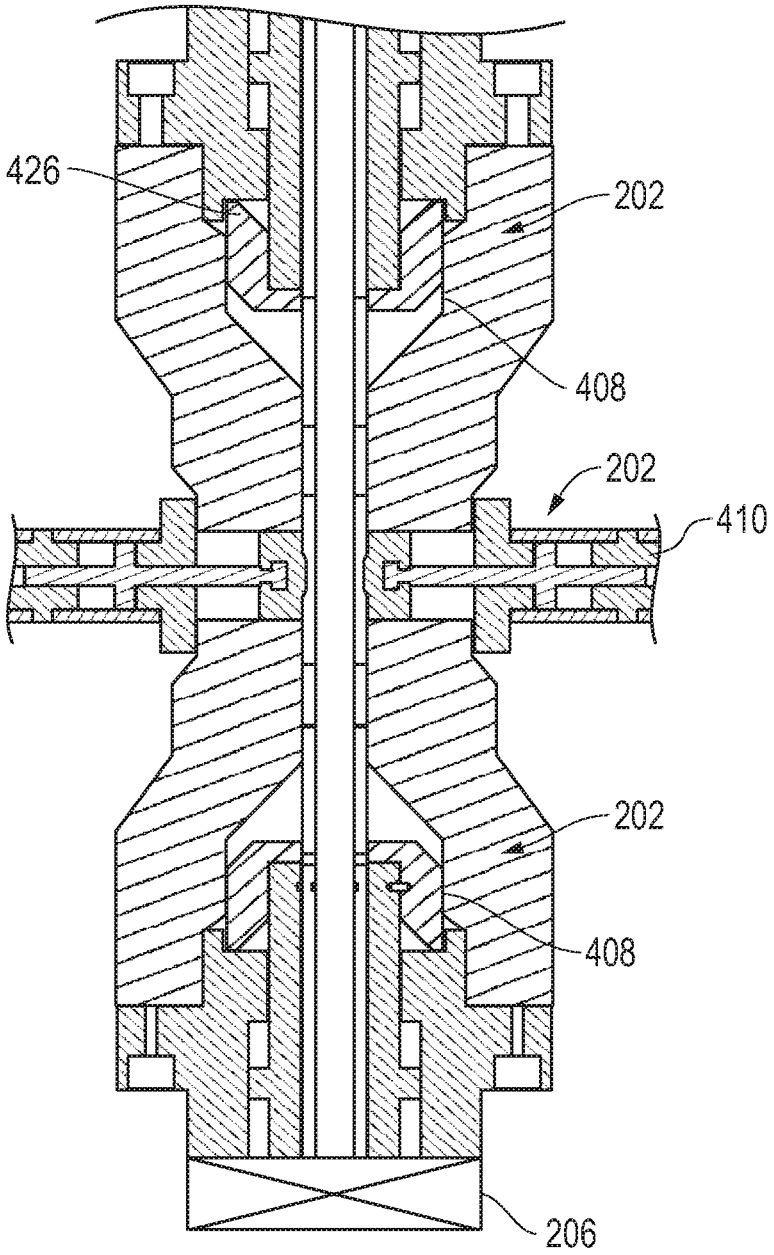
Figure 12C:
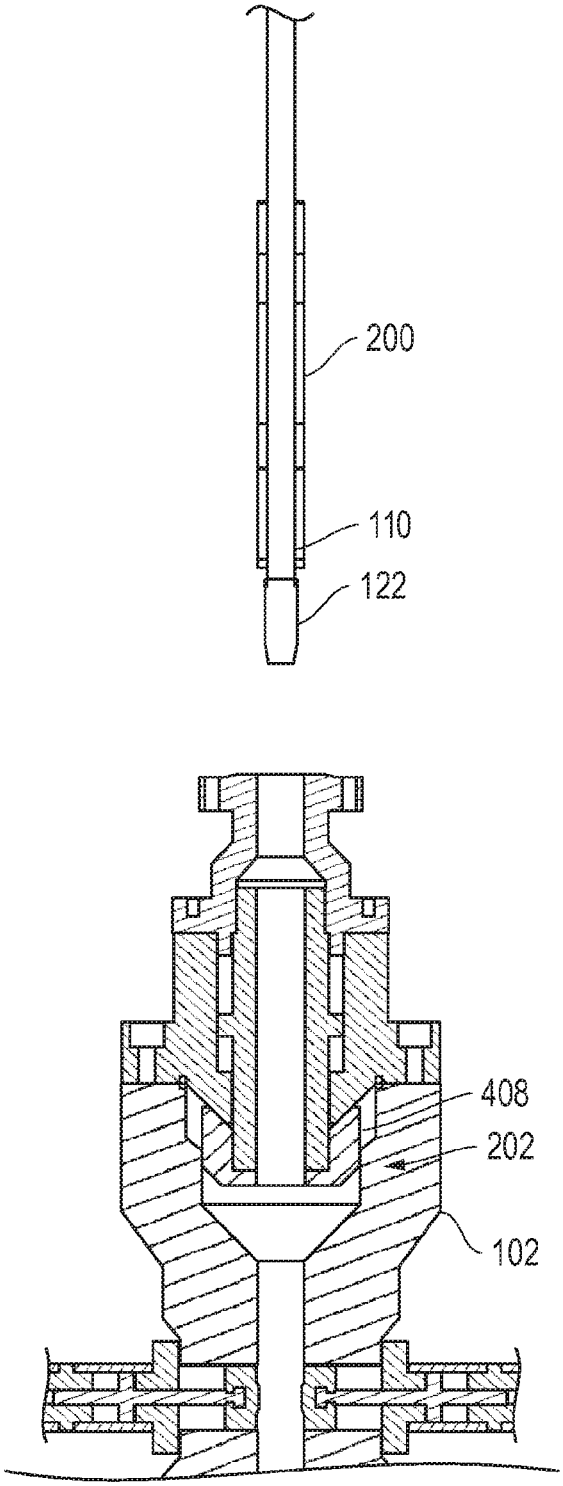

FIGS. 12A-12C show a sequence of removing the conveyance 110 and the seal assembly 200 from the stripper 102. The conveyance 110 with the one or more downhole tools 122 may be run up-hole until the downhole tools 122 and/or the end of the conveyance 110 are past the BOP 114 and/or the stop 206. The downhole tools 122 may then engage the lowermost of the one or more packer actuators 408. A decrease in the tension, or force in the conveyance 110 may indicate that the downhole tools 122 have reached the proper position above the stop 206 and/or the BOP 114. The stop 206 and/or the BOP 114 may then be closed in order to prevent fluid flow from the wellbore 112 (as shown in FIG. 1) to the stripper 102. The actuators 202, for example the packer actuators 408 and the locator actuators 410, of the stripper 102 may then be opened, thereby releasing the seal assembly 200 from the stripper 102 as shown in FIG. 12B. With the actuators 202 in the open position, the conveyance 110 may be moved out of the stripper 102. As the conveyance 110 leaves the stripper 102, the downhole tools 122, or the end of the conveyance 110 may engage the seal assembly 200 thereby removing the seal assembly 200 from the stripper 102 as shown in FIG. 12C. The seal assembly 200 may then be removed from the conveyance 110 and a new seal assembly 200 may be placed on the conveyance 110 for further use. Further, a different type of conveyance 110, for example a wireline may be deployed into the stripper 102. The wireline conveyance may have the same type of seal assembly 200 deployed with it. In such cases, a smaller inner diameter may be used.

Figure 13:
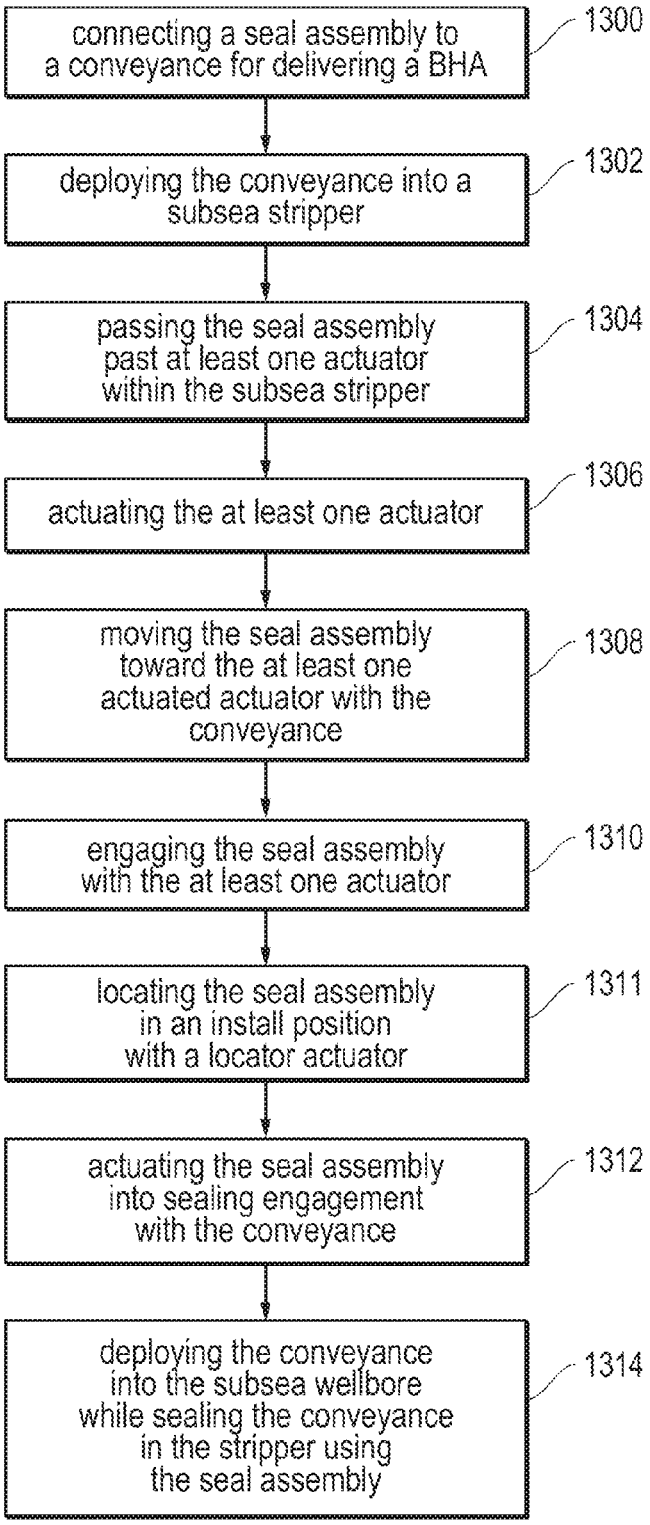
FIG. 13 is a flow chart illustrating a method for replacing equipment at a wellsite.

FIG. 13 is a flowchart depicting a method for replacing equipment at a wellsite. The method connects 1300 a seal assembly to a conveyance for delivering a BHA. The seal assembly may have at least one packer extendable within the subsea stripper to form a seal thereabout, at least one locator for positioning the seal assembly in an install position within the subsea stripper, and a frangible member for connecting the seal assembly to the conveyance prior to deployment in the subsea stripper. The method continues by deploying 1302 the conveyance into the subsea stripper and passing 1304 the seal assembly past at least one actuator within the subsea stripper. The method continues by actuating 1306 the at least one actuator and moving 1308 the seal assembly toward the at least one actuated actuator with the conveyance and thereby engaging 1310 the seal assembly with the at least one actuator. The method continues by actuating 1312 the seal assembly into sealing engagement with the conveyance. The method continues by locating 1311 the seal assembly in an install position with a locator actuator and deploying 1314 the conveyance into the subsea wellbore while sealing the conveyance in the stripper using the seal assembly.

To automate the replacement of the one or more seal assemblies 200, the equipment replacement system 104 may be in communication with the controller(s) 130/132. The equipment replacement system 104 may communicate with the controllers 130 and/or 132 via one or more communication links 133, as shown in FIG. 1. The communication links 133 may be any suitable communication means such as hydraulic lines, pneumatic lines, wiring, fiber optics, telemetry, acoustic device, wireless communication, any combination thereof, and the like. Further, any of the devices and/or systems in the subsea system 106 may communicate with the subsea controller 132 and/or the controller 130 via the communication links 133. Further still, the subsea controller 132 may communicate with the controller 130 via the communication links 133.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A replaceable seal assembly for sealing equipment at a wellsite, the wellsite having a subsea stripper installed proximate a subsea borehole and a conveyance for delivering a bottom hole assembly into the subsea borehole, the replaceable seal assembly comprising:

at least one locator sleeve positionable within the subsea stripper;

at least one packer carried by the at least one locator sleeve, the at least one packer extendable within the subsea stripper to form a seal thereabout; and a frangible member operatively connectable to the at least one locator sleeve and detachably connectable to the conveyance whereby the at least one packer is detachably deployable into the subsea stripper via the conveyance.

2. The replaceable seal assembly of claim 1, wherein the at least one packer further comprises two packers with the at least one locator sleeve located therebetween.

3. The replaceable seal assembly of claim 1, further comprising at least one actuation sleeve to actuate the at least one packer.

4. The replaceable seal assembly of claim 3, wherein the at least one actuating sleeves further comprises a tapered end to engage an actuator of the subsea stripper, and wherein the tapered end axially aligns the at least one packer within the subsea stripper.

5. The replaceable seal assembly of claim 1, wherein the at least one locator sleeve further comprises a guide to align the seal assembly in an install position when the guide is engaged by a locator actuator of the subsea stripper.

6. The replaceable seal assembly of claim 5, wherein the guide further comprises a reduced necked-down dual chamfer.

7. A system for replacing equipment at a wellsite, the wellsite having subsea equipment installed proximate a subsea borehole and a conveyance to deliver a bottom hole assembly into the subsea borehole, the system comprising:

a subsea stripper having a central bore therethrough;

at least one replaceable seal assembly installable within the central bore of the subsea stripper, the at least one replaceable seal assembly comprising:

at least one locator sleeve positionable within the subsea stripper;

at least one packer carried by the at least one locator sleeve, the at least one packer extendable within the subsea stripper to form a seal thereabout; and a frangible member operatively connectable to the at least one locator sleeveand detachabley connectable to the conveyance whereby the at least one packer is detachably deployable into the subsea stripper via the conveyance; and at least one actuator to actuate the at least one packer whereby the subsea borehole is sealed.

8. The system of claim 7, wherein the at least one actuator further comprises at least one packer actuator and at least one locator actuator.

9. The system of claim 8, wherein the at least one locator actuator is engageable with the at least one locator sleeve of the at least one replaceable seal assembly to move the at least one replaceable seal assembly to an install position.

10. The system of claim 9, wherein the at least one locator actuator further comprises an engager to mate with a guide on the at least one locator sleeve.

11. The system of claim 8, wherein the at least one packer actuator comprises a motivator to motivate the at least one packer within the subsea stripper and wherein the motivator moves in a longitudinal direction relative to the at least one replaceable seal assembly during actuation of the at least one packer and moves in a radial direction in order to allow the at least one replaceable seal assembly to be installed and removed from the subsea stripper.

12. The system of claim 11, wherein the motivator comprises a slip surface to engage a bowl of the at least one packer actuator, wherein the slip surface and the bowl facilitate movement of the motivator in the radial direction.

13. The system of claim 11, wherein the motivator engages an actuation sleeve of the at least one replaceable seal assembly.

14. A method for replacing equipment at a wellsite, the wellsite having a subsea stripper located proximate a subsea borehole, the method comprising:

connecting a seal assembly to a conveyance to deliver a bottom hole assembly, the seal assembly comprising:

at least one locator sleeve positionable within the subsea stripper;

at least one packer carried by the at least one locator sleeve, the at least one packer extendable within the subsea stripper to form a seal thereabout; and a frangible member operatively connectable to the at least one locator sleeve and detachably connectable to the conveyance whereby the at least one packer is detachably deployable into the subsea stripper via the conveyance;

deploying the seal assembly into the subsea stripper via the conveyance;

locating the seal assembly in an install position in the subsea stripper with a locator actuator; and actuating at least one of the at least one packers into sealing engagement about the subsea stripper.

15. The method of claim 14, wherein locating the seal assembly further comprises:

actuating a motivator of at least one packer actuator into a position to engage the seal assembly; and engaging the seal assembly with the motivator.

16. The method of claim 14, further comprising breaking the frangible member to disengage the conveyance from the seal assembly.

17. The method of claim 14, further comprising opening a stop of the subsea stripper after the seal assembly is in sealing engagement with the conveyance.

18. The method of claim 17, further comprising running the bottom hole assembly past the stop and performing downhole operations.

19. The method of claim 18, further comprising removing the seal assembly, the conveyance and the bottom hole assembly from the subsea stripper.

20. The method of claim 19, further comprising installing a new conveyance with a new seal assembly, wherein the conveyance has a first outer diameter and the new conveyance has a second outer diameter.

21. The replaceable seal assembly of claim 1, further comprising a bushing on each side of the at least one packer.

22. The replaceable seal assembly of claim 1, further comprising at least one sleeve connection member connecting the at least one locator sleeve to the at least one packer.

23. The replaceable seal assembly of claim 22, wherein the at least one sleeve connection member comprises a plurality of segments movable between an expanded and retracted position.

24. A system for replacing equipment at a wellsite, the wellsite having subsea equipment installed proximate a subsea borehole and a conveyance to deliver a bottom hole assembly into the subsea borehole, the system comprising:

a subsea stripper having a central bore to pass the conveyance and the bottom hole assembly therethrough;

at least one replaceable seal assembly installable within the subsea stripper, the at least one replaceable seal assembly comprising:

at least one locator sleeve positionable within the subsea stripper;

at least one packer carried by the at least one locator sleeve, the at least one packer extendable within the subsea stripper to form a seal thereabout and a frangible member operatively connectable to the at least one locator sleeve and detachably connectable to the conveyance whereby the at least one packer is detachably deployable into the subsea stripper via the conveyance; and at least one packer actuator to selectively actuate the at least one packer and at least one locator actuator to selectively engage the at least one locator sleeve of the at least one replaceable seal assembly whereby the subsea borehole is sealable.

* * * * *